US006085822A

United States Patent [19]

Miller

[11] Patent Number: 6,085,822

[45] **Date of Patent: *Jul. 11, 2000**

[54] DEPLOYMENT CONTROL FOR ROLLING PROTECTIVE SHUTTERS

[76] Inventor: James V. Miller, 893 N. Maryknoll Cir., Glen Ellyn, Ill. 60137

[ * ] Notice: This patent is subject to a terminal disclaimer.

[21] Appl. No.: 08/997,011

[22] Filed: Dec. 23, 1997

Related U.S. Application Data

[63] Continuation-in-part of application No. 08/804,100, Feb. 20, 1997, Pat. No. 5,850,862.

[51] Int. Cl.[7] ..... E06B 9/08

[52] U.S. Cl. ..... 160/133; 160/183

[58] Field of Search ..... 160/133, 183, 160/23.1, 26, 270, 271, 272, 273.1, 32, 35, 36, 41, 84.06, 172 R, 236, 232, 235

[56] References Cited

U.S. PATENT DOCUMENTS

| | | | |
|---|---|---|---|
| 876,593 | 1/1908 | Rush . | |
| 1,352,656 | 9/1920 | Cahill . | |
| 1,579,839 | 4/1926 | Raper . | |
| 3,431,964 | 3/1969 | Rogers | 160/273 |
| 4,037,639 | 7/1977 | Jones | 160/133 |
| 4,345,635 | 8/1982 | Solomon | 160/133 |
| 4,386,645 | 6/1983 | Dever et al. | 160/183 |
| 4,690,193 | 9/1987 | Morrison et al. | 160/133 |
| 4,718,472 | 1/1988 | Hörmann | 160/229 R |
| 4,723,588 | 2/1988 | Rüppel | 160/236 |
| 4,795,206 | 1/1989 | Adams | 296/98 |
| 5,070,925 | 12/1991 | Paule | 160/133 |

(List continued on next page.)

FOREIGN PATENT DOCUMENTS 1 237 289 3/1967 Germany .

OTHER PUBLICATIONS

Alulux, "The Anti–Push–Up Lock for All Alulux Roller Shutters," one page, double–sided.

Lakal Rolladensysteme, Neuheiten aus unserem Herstellungsprogramm, "Lakal Profil AHS 75," "Kakal Rollgitter," "Kakal Blendkappen 254 RS and 304 RS," and "Lakal Sicherheits–Führungsschiene," 4 pages.

Sweet's General Building & Renovation 1993 Catalog File, Roll–a–way Insulating Security Shutters, Sweet's General Building & Renovation 1993 Catalog File, B500, 08667/ROM, BuyLine 1239, pp. 1–8.

SIRO—Safety Roller Blinds, "Safety roller blind Type Sd," "Safety roller blind Type Se 2 mm and Type Se 3 mm," "Safety roller blinds," 4 pages.

Sweet's General Building & Renovation 1993 Catalog File, Solaroll® Shade & Shutter Corporation, Sweet's General Building & Renovation 1993 Catalog File, Catalog 561, B50–5, 08667/SOL, BuyLine 1828, pp. 1–40, Oct. 1, 1986.

*Primary Examiner*—David M. Purol

*Attorney, Agent, or Firm*—Marshall, O'Toole, Gerstein, Murray & Borun

[57] ABSTRACT

A rolling shutter assembly having a shutter support member and a shutter coupled to the shutter support member. The shutter has a plurality of individual slats and a plurality of hinges interconnecting the slats. Each of the slats has a pair of end portions, and the slats include a first set of slats and a second set of slats, each of the slats in the first and second sets being alternated so that each of the hinges is connected to one of the slats in the first set and one of the slats in the second set. The shutter further includes a plurality of extension members extending from the slats and/or the hinges. The shutter assembly has a pair of shutter tracks and an arrangement for rolling the shutter from an extended position in which the end portions of the slats are disposed in the shutter tracks to a retracted position in which the shutter is rolled up on the shutter support member. The shutter tracks further include guide channels and guide arrangements which cause the extension members to be disposed within the guide channels to cause the slats in the first set of slats to occupy a first relative position and the slats in the second set of slats to occupy a second relative position while the shutter is being unrolled.

8 Claims, 23 Drawing Sheets

U.S. PATENT DOCUMENTS 5,172,744 12/1992 Finch et al. ..... 160/133
5,204,147 4/1993 Schneider ..... 428/35.8
5,209,281 5/1993 Kraeutler ..... 160/84.1
5,343,924 9/1994 Hoffman ..... 160/235
5,365,990 11/1994 Ueda ..... 160/23.1
5,469,905 11/1995 McKinney et al. ..... 160/35
5,575,322 11/1996 Miller ..... 160/133
5,586,592 12/1996 McGregor ..... 160/133
5,601,130 2/1997 Werner et al. ..... 160/183
5,611,383 3/1997 Hoffman ..... 160/133
5,613,539 3/1997 Kraler ..... 160/32

22
20
82
84a
64
62
84b
106
56
86b
84a
86a
90a
92a
104
88
58
92b
90b
84b
106
96b
86b
66
96a
84a
60

DEPLOYMENT CONTROL FOR ROLLING PROTECTIVE SHUTTERS

CROSS-REFERENCE TO RELATED APPLICATION

This application is a continuation-in-part of U.S. application Ser. No. 08/804,100, filed Feb. 20, 1997 now U.S. Pat. No. 5,850,862.

BACKGROUND OF THE INVENTION

The present invention is directed to a rolling protective shutter assembly which has a protective shutter, for covering a window or door opening, that may be rolled up into a shutter housing when not in use.

Rolling protective shutters are conventional and are used to provide protection against extreme weather conditions and to deter theft, for example. One such rolling protective shutter is disclosed in U.S. Pat. No. 5,575,322, issued to Miller on Nov. 19, 1996, entitled "Rolling Protective Shutters," which is hereby expressly incorporated by reference herein. As shown in FIGS. 1 and 2 of that patent, the Miller shutter is composed of a plurality of individual slats and a plurality of hinges interconnecting the slats. Each of the slats has a pair of end portions, and the slats include a first set of slats and a second set of slats, each of the slats in the first and second sets being alternated so that each of the hinges is connected to one of the slats in the first set and one of the slats in the second set. The shutter assembly has a pair of shutter tracks and means for rolling the shutter from an extended position in which the end portions of the slats are disposed in the shutter tracks to a retracted position in which the shutter is rolled up on a shutter support member. The hinges and the shutter tracks are adapted to facilitate, when the shutter is in the extended position, the slats in the first set of slats to occupy a first relative position and the slats in the second set of slats to occupy a second relative position.

SUMMARY OF THE INVENTION

In one aspect, the present invention is directed to a rolling shutter assembly having a pair of shutter tracks having guide means adapted to facilitate shutter slats occupying different relative orientations. The rolling shutter assembly has a shutter support member, a shutter coupled to the shutter support member, and a pair of shutter tracks. The shutter is formed of a plurality of shutter members including a slat and a hinge connected to the slat. The shutter members are grouped in a first set and a second set. Each of the shutter members of the first set have a first end portion with a first extension member extending outwardly from the first end portion, and each of the shutter members of the second set have a second end portion with a second extension member extending outwardly from the second end portion.

The shutter assembly further includes means for rolling the shutter from an extended position in which portions of the slats are disposed in the shutter tracks to a retracted position in which the shutter is rolled up on the shutter support member. Each of the shutter tracks has an associated guide channel, and each guide channel has an associated guide means which causes the first extension members to be disposed within the guide channel when the shutter is in the extended position.

In one alternative embodiment, the guide means includes a rigid member adapted to engage the first extension members and a guide member adapted to engage the second extension members so that the second extension members are disposed outside the guide channels. The guide member may be a gate pivotally connected to the shutter track and adapted to deploy the first extension members within the guide channel and to deploy the second extension members outside the guide channel.

In another alternative embodiment, the guide means includes a rigid member adapted to engage the first extension members and a guide member adapted to engage the shutter members of the second set so that the second extension members are disposed outside the guide channels. The guide member may be a resilient member, such as a piece of spring steel or a compression spring. The resilient member is adapted to deflect when engaged by the shutter members of the first set to allow the first extension members to enter the guide channel, and to resist deflection when engaged by the shutter members of the second set to prevent the second extension members from being disposed within the guide channel.

In another aspect, the present invention is directed to a rolling shutter assembly having a shutter adapted to prevent the hinges from linearly aligning. The rolling shutter assembly has a shutter support member, a shutter coupled to the shutter support member, and a pair of shutter tracks. The shutter is formed of a plurality of slats and a plurality of hinges interconnecting the slats. The hinges are grouped in a first set and a second set, with each of the hinges in the first and second sets being alternated. The shutter assembly further includes means for rolling the shutter from an extended position in which portions of the slats are disposed in the shutter tracks to a retracted position in which the shutter is rolled up on the shutter support member. In one embodiment, each hinge of the first set is adapted to restrict the rotation of the hinge of the first set to prevent the hinge of the first set from linearly aligning with the hinges of the second set. In another embodiment, each of the slats includes a first slat portion and a second slat portion angled relative to said first slat portion.

In another aspect, the present invention is directed to a rolling shutter assembly having a shutter adapted to accommodate shutter tracks of varying lengths. The rolling shutter assembly has a shutter support member, a shutter coupled to the shutter support member, and a pair of shutter tracks. The shutter is formed of a plurality of slats and a plurality of hinges interconnecting the slats. The hinges are grouped in a first set and a second set, with each of the hinges in the first and second sets being alternated. The shutter assembly further includes means for rolling the shutter from an extended position in which portions of the slats are disposed in the shutter tracks to a retracted position in which the shutter is rolled up on the shutter support member. The shutter assembly further includes a slat having an adjustable width. The adjustable width slat is positioned as either the bottom-most slat, or as the top-most slat which connects the shutter to the shutter support member.

The features and advantages of the invention will be apparent to those of ordinary skill in the art in view of the detailed description of the preferred embodiments, which is made with reference to the drawings, a brief description of which is provided below.

BRIEF DESCRIPTION OF THE DRAWINGS

FIG. 17(*d*) is a partial side sectional view of a shutter assembly including bent slats to restrict hinge rotation according to the present invention;

DETAILED DESCRIPTION OF THE PREFERRED EMBODIMENTS

Figure 1:
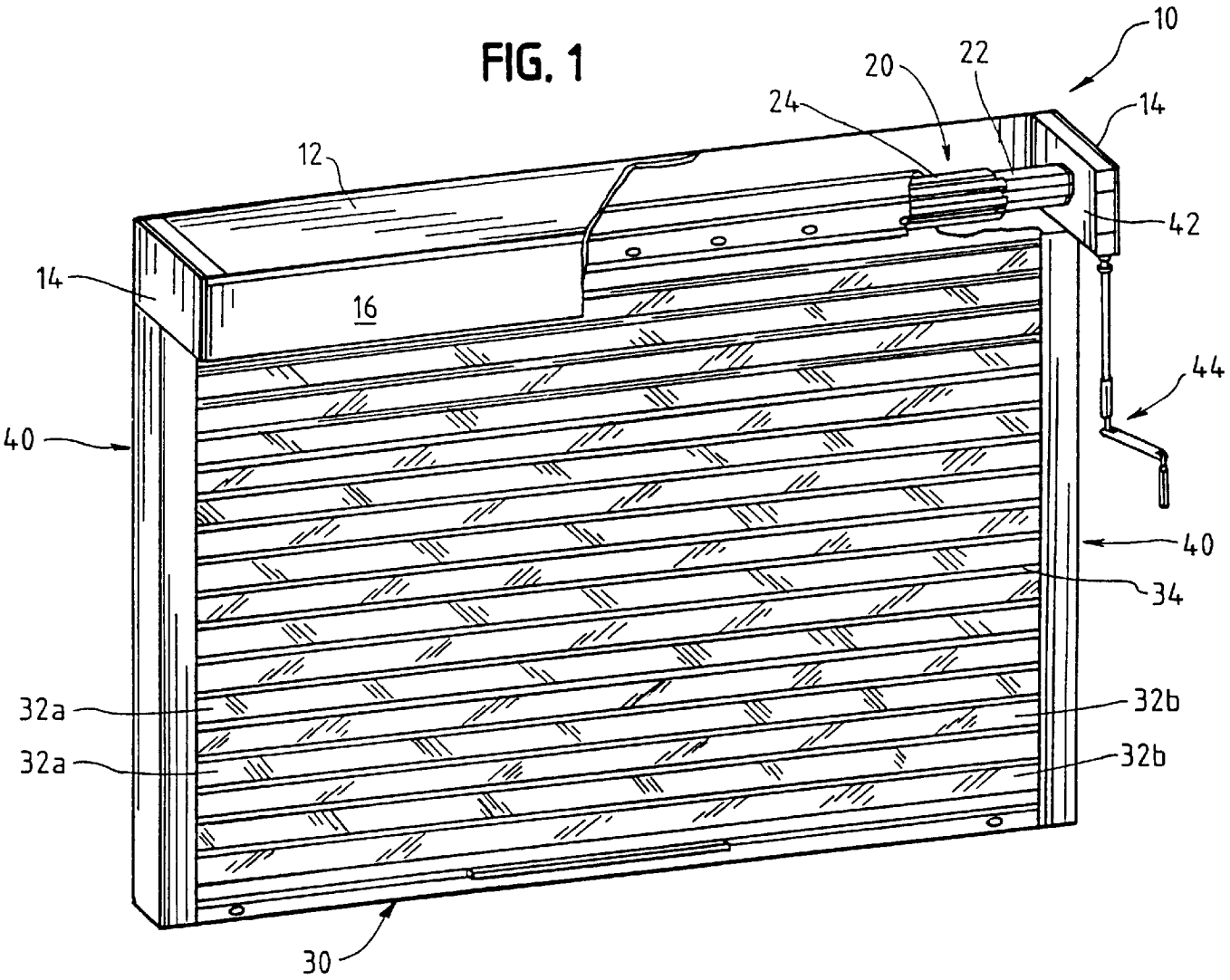
FIG. 1 is a perspective view of a first embodiment of a rolling shutter assembly in accordance with the invention.
Figure 2:
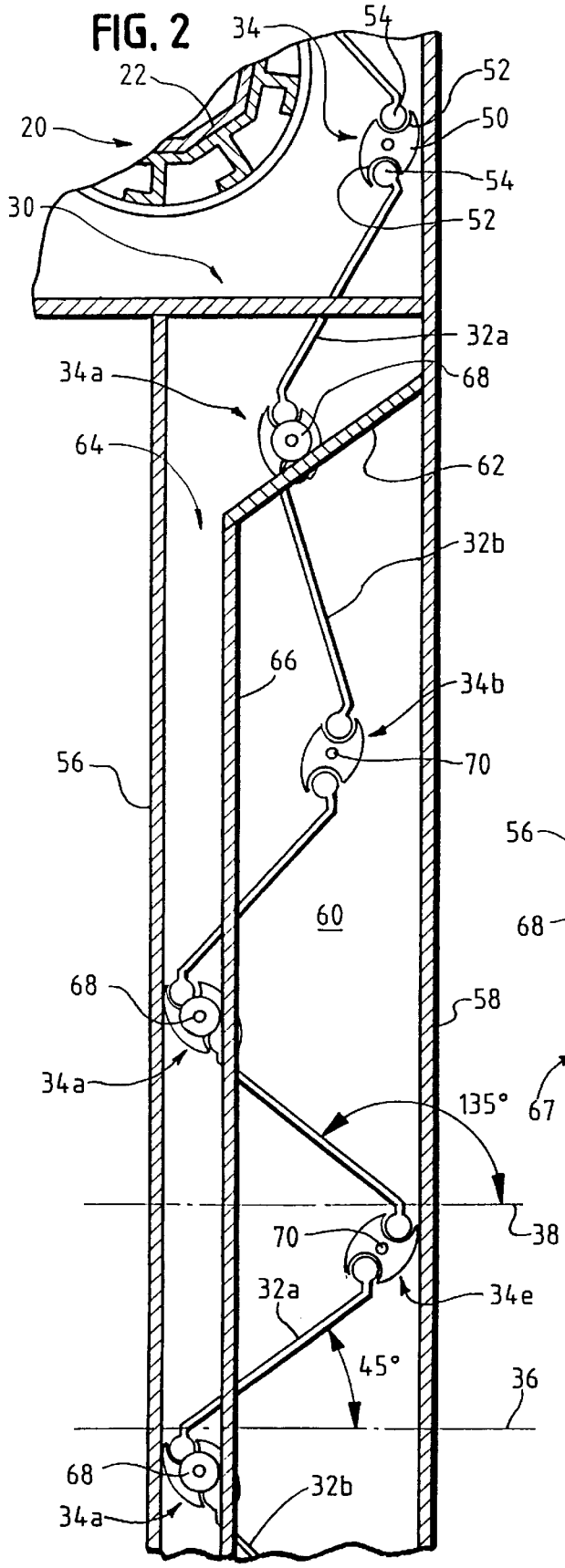
FIG. 2 is a cross-sectional side view of a portion of the shutter assembly of FIG. 1.

A first embodiment of a rolling shutter assembly 10 in accordance with the invention is shown in FIGS. 1–2. Referring to FIG. 1, the shutter assembly 10 has a shutter housing which includes a top wall 12, a pair of side walls 14, and a front wall 16. A shutter support member 20 is mounted for rotation within the shutter housing. The support member 20 includes a generally cylindrical central shaft 22 and a plurality of mounting members 24 fixed to the shaft 22.

The upper end of a rolling shutter 30 is coupled to the mounting members 24. The shutter 30 is composed of a plurality of individual, elongate slats 32. The slats 32, each of which is substantially flat, having two substantially planar side portions, and which may be composed of steel, are interconnected by a plurality of hinges 34, each of which joins together a pair of adjacent slats 32. The slats 32 include a first set of slats 32*a* and a second set of slats 32*b*, the first and second sets of slats being alternated, so that each hinge 34 is connected to one of the slats 32*a* in the first set and one of the slats 32*b* in the second set.

When the shutter 30 is in its unrolled position as shown in FIG. 2, the slats 32*a* in the first set occupy a first relative position in which they are aligned with a first angled direction, shown to be about 45° with respect to a horizontal axis 36, and the slats 32*b* in the second set occupy a second relative position in which they are aligned with a second angled direction, shown to be about 135° with respect to a horizontal axis 38. The angular position of the slats 32 could be varied so that the slats 32*a* in the first set occupy an angled direction between about 10° and about 80° with respect to the horizontal and so that the slats 32*b* in the second set occupy an angled direction between about 100° and about 170° with respect to the horizontal.

Referring back to FIG. 1, the ends of the slats 32 are disposed within a pair of shutter tracks 40. The shutter assembly 10 has a gearbox 42 which interconnects the rotatable shaft 22 with a handle 44 via a conventional gear assembly (not shown). When mounted to protect a window, the shutter tracks 40 of the shutter assembly 10 are positioned on either side of the window and the shutter housing is positioned over the top of the window. When the shutter 30 is not in use, it is rolled up on the shutter support member 20 via the handle 44 so that it is at least partially enclosed by the shutter housing. The handle 44 may be disposed on a rear portion of the shutter assembly 10 so that the shutter 30, when attached over a window for example, can be unrolled from inside the window.

Referring to FIG. 2, each of the hinges 34 is composed of an elongate member 50 having a pair of semi-circular sockets 52 formed therein and a pair of circular rods 54 pivotally disposed therein, each of the rods 54 being fixed to one of the slats 32 adjacent the hinge 34. Since the sockets 52 cover slightly over half the diameter of the rods 54, the rods 54 are permanently retained within the sockets 52. When the shutter 30 is in its unrolled position as shown in FIG. 2, each of the hinges 34 makes contact with one side of the shutter tracks 40.

The hinges 34 are grouped into a first set of hinges 34*a* and a second set of hinges 34*b* alternated with the first set of hinges 34*a*. The first set of hinges 34*a* include first extension members, such as rollers 68, which extend outwardly from the end of the hinge 34*a*. The second set of hinges 34*b* may include second extension members, such as pins 70, which extend outwardly from the end of the hinge 34*b*.

Figure 3:
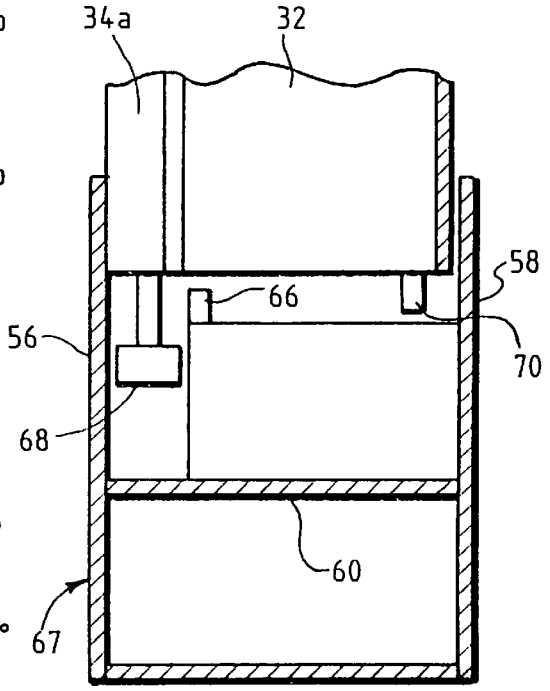
FIG. 3 is a cross-sectional top view of a portion of the shutter assembly of FIG. 1.

The structure of the shutter tracks 40 is illustrated in FIGS. 2 and 3. Each shutter track 40 is composed of a pair of side walls 56, 58 joined by an end wall 60. A plate 62 is attached proximate the end wall 60 and directs the roller 68 on hinge 34*a* into a guide channel 64 as the shutter 30 is unrolled from the shutter support member 20. The guide channel 64 is formed by the side wall 56 and a guide wall 66. As shown in FIG. 3, a structural support member 62 may be disposed on the outside of the end wall 60 to provide additional structural support to the shutter track 40.

Referring to FIG. 2, the plate 62 and guide channel 64 act to shape the shutter 30 as it is unrolled from the shutter support member 20 to an extended position. As the shutter 30 is unrolled, the rollers 68 on the hinges of the first set 34*a* come into contact with the plate 62 which directs the hinge 34*a* toward the guide channel 64. Once in the guide channel 64, the guide wall 66 retains the roller 68 within the guide channel 64. As illustrated in FIG. 3, the pins 70 is short enough so that the pin 70 does not contact the plate 62, and long enough so that the pin 70 will contact the guide wall 66, thus preventing the hinges 34*b* from entering the guide channel 64. Consequently, as the shutter 30 is unrolled, the hinges 34*a* are disposed on one side of the guide wall 66 and the hinges 34*b* are disposed on the other side of the guide wall 66, thus forming the desired V-shape, as shown in FIG. 2.

Extension members, such as rollers 68 and pins 70 disclosed herein and in subsequent examples, are attached to the hinges 34 for illustrative purposes. It is within the province of one skilled in the art to attach rollers, pins, bushings or other extension members to the slats 32 to achieve the same results.

Figure 4:
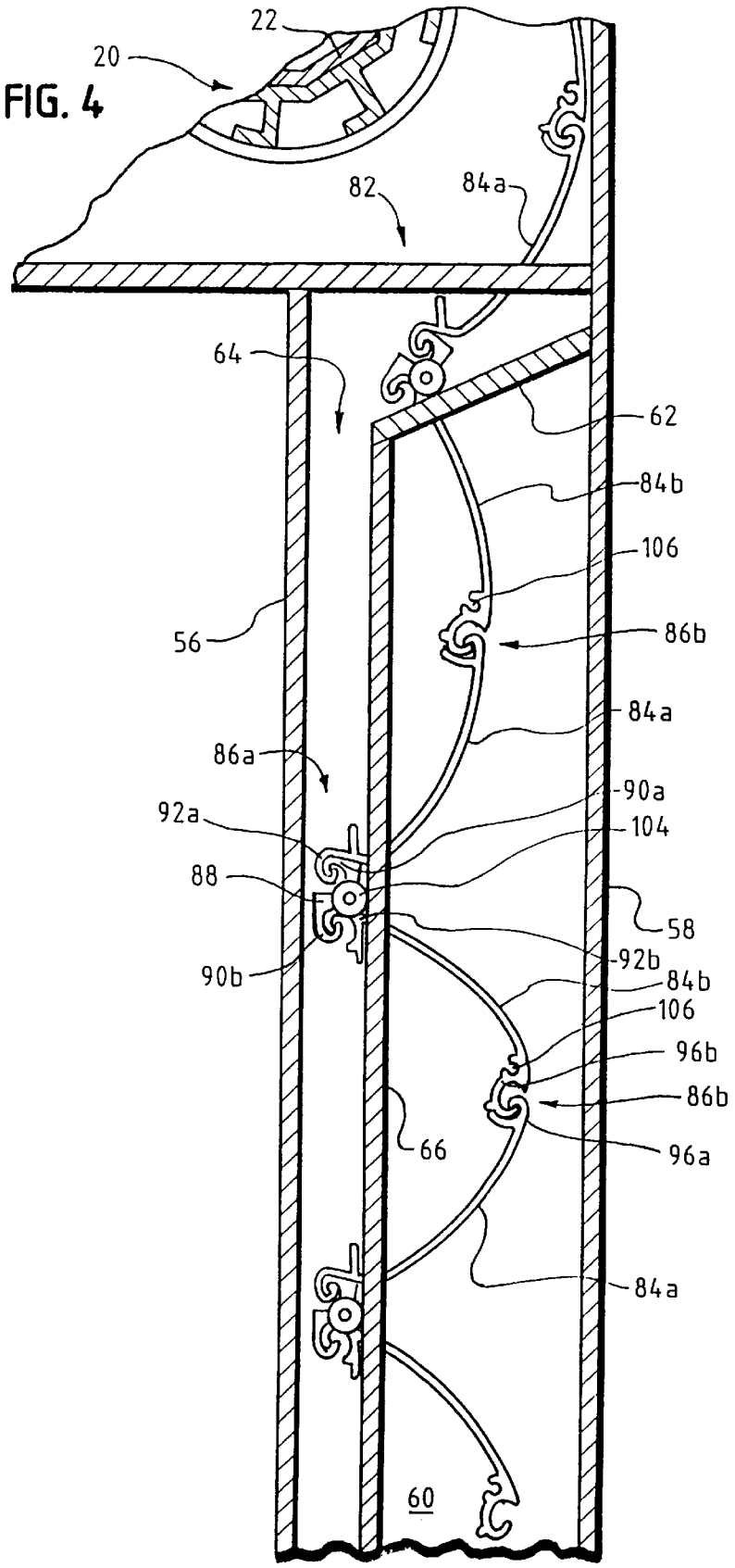
FIG. 4 is a cross-sectional side view of a portion of a second embodiment of a shutter assembly in accordance with the invention.
Figure 6:
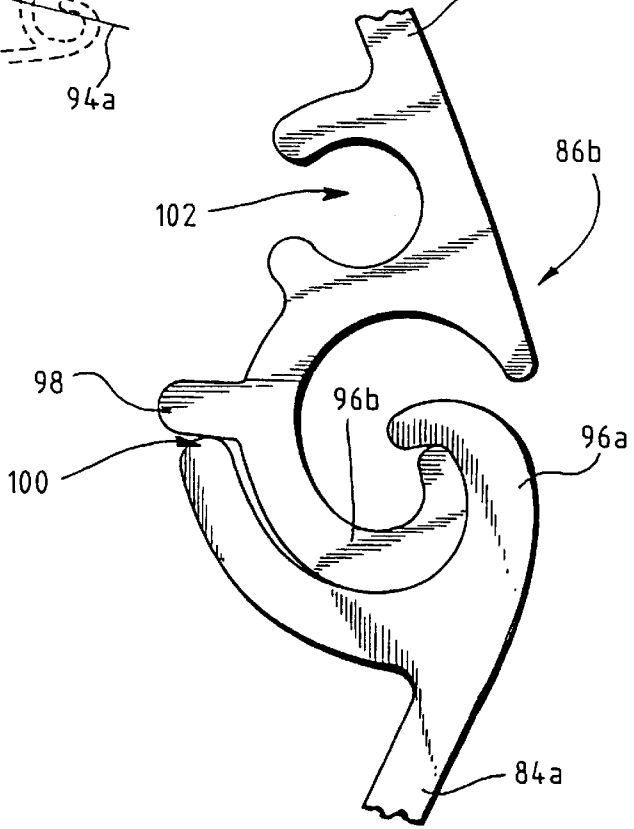
FIG. 6 is a side view or a pair of individual shutter slats pivotally interconnected via another alternative hinge.
Figure 5:
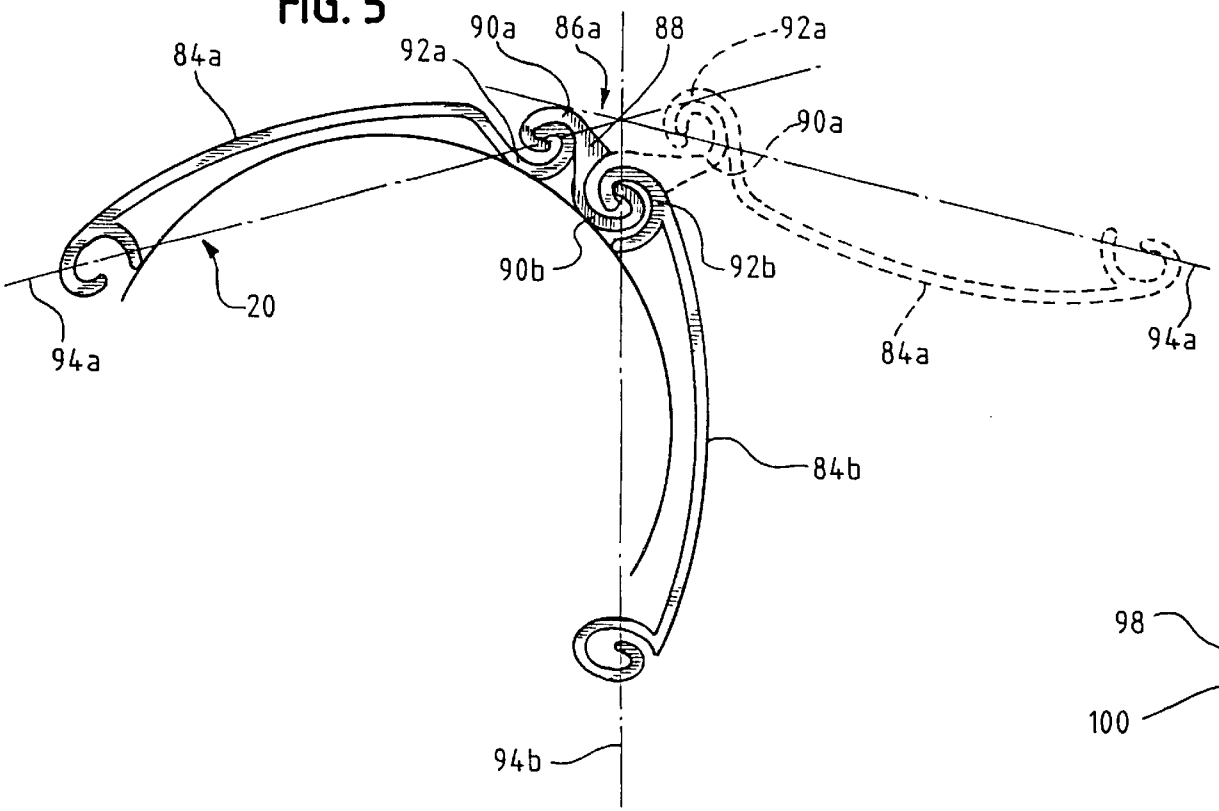
FIG. 5 is a side view of a pair of individual shutter slats pivotally interconnected via an alternative hinge.

A portion of a second embodiment of a shutter assembly 80 is shown in FIGS. 4–6. The shutter assembly 80 has the same components of the shutter assembly 10 of FIG. 1, except that the structure of the shutter 82 is different. The shutter assembly 80 has a shutter 82 which has a first set of slats 84*a* and a second set of slats 84*b* alternated with the first set of slats 84*a*. The shutter assembly 80 also has a shutter 82 which has a first set of spiral hinges 86*a* and a second set of spiral hinges 86*b* alternated with the first set of spiral hinges 86*a*.

An example of a spiral hinge of the first set 86*a* is illustrated in FIG. 5. Each hinge 86*a* is composed of a link 88 having a first pair of spiral sections 90*a*, 90*b* formed therein, and a second pair of spiral sections 92*a*, 92*b* fixed to slats 84*a*, 84*b*, respectively. Spiral section 90*a* interlocks spiral section 92*a* and spiral section 90*b* interlocks spiral section 92*b* in a manner that allows the rotation of slats 84*a*, 84*b* relative to link 88. Hinge 86*a* permits a broad range of motion for slat 84*a* relative to slat 84*b*. This range includes acute angles when shutter 80 is rolled up on shutter support member 20, shown to be about 75° between a center line 94*a* on slat 84*a* and a center line 94*b* on slat 84*b*, and extreme angles when shutter 80 is in the extended position, shown to be about 283° between center lines 94*a*, 94*b*. Persons of skill in the art will be able to adapted hinge 86*a* to allow for a range of motion in excess of 330°.

Referring to FIG. 6, an example of a hinge of the second set 84*b* is illustrated. Hinge 84*b* is composed of a pair of spiral sections 96*a*, 96*b* fixed to slats 84*a*, 84*b*, respectively. Spiral section 96*a* interlocks spiral section 96*b* in a manner that allows the rotation of slat 84*a* relative to slat 84*b*. Spiral section 96*b* may be provided with a rigid member, such as extrusion 98, which extends from spiral section 96*b* and engages a tip 100 of spiral section 96*a* at a point in the rotation, thus preventing further rotation in hinge 86*b*. Extrusion 98 is essentially a cantilever beam extending from spiral section 96*b*, but those skilled in the art will identify other methods for stopping the rotation of hinge 86*b* at a fixed point. Spiral section 96*b* may also be provided with an opening, such as boss 102, for attachment of an extension member, such as a roller or pin as described above.

Referring back to FIG. 4, the plate 62 and guide channel 66 act to shape the shutter 82 as it is unrolled from the shutter support member 20 to its extended position. As the shutter 82 is unrolled, rollers 104 on the hinges of the first set 86*a* come into contact with the plate 62 which directs the hinge 86*a* toward the guide channel 64. Once in the guide channel 64, the guide wall 66 retains the roller 104 within the guide channel 64. Pins 106 extend far enough from the hinges 86*b* to contact the guide wall 66 while avoiding the plate 62, thus preventing the hinges 86*b* from entering the guide channel 64. Consequently, as the shutter 82 is unrolled, the hinges 86*a* are disposed on one side of the guide wall 66 and the hinges 86*b* are disposed on the other side of the guide wall 66, thus forming the desired V-shape.

Figure 9A:
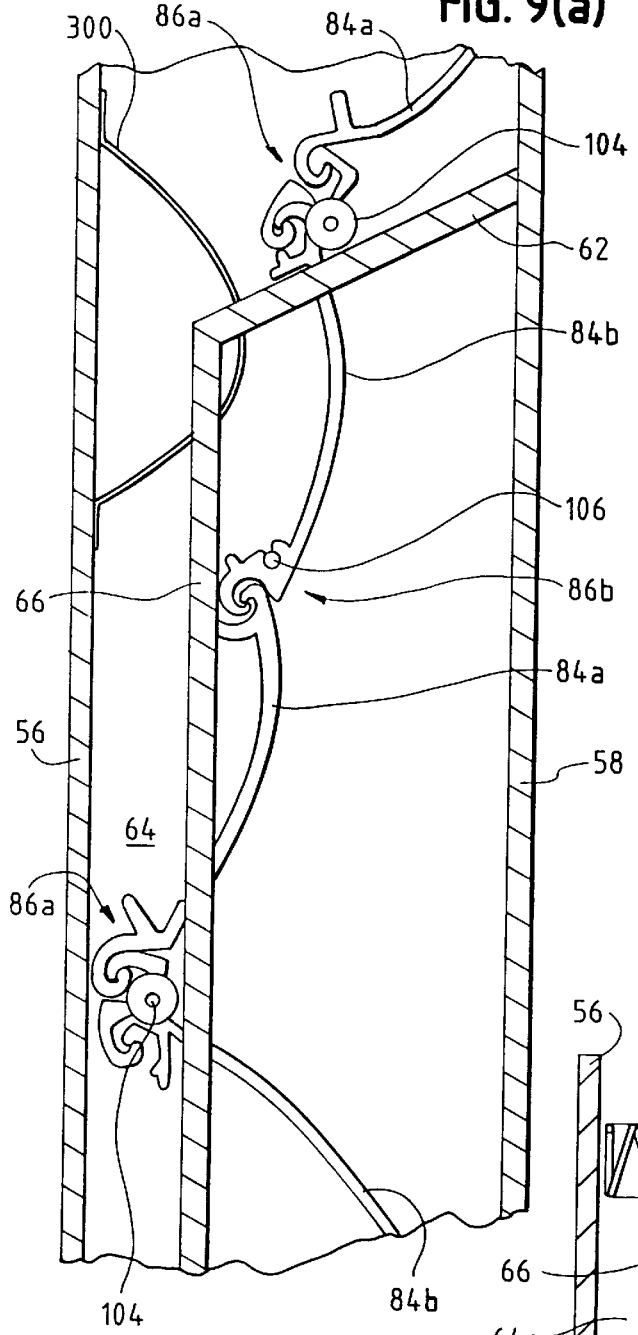
FIGS. 9(*a*) and (*b*) are partial side and top sectional views of a shutter assembly utilizing a spring member for deployment control according to the present invention in a first position.
Figure 9B:
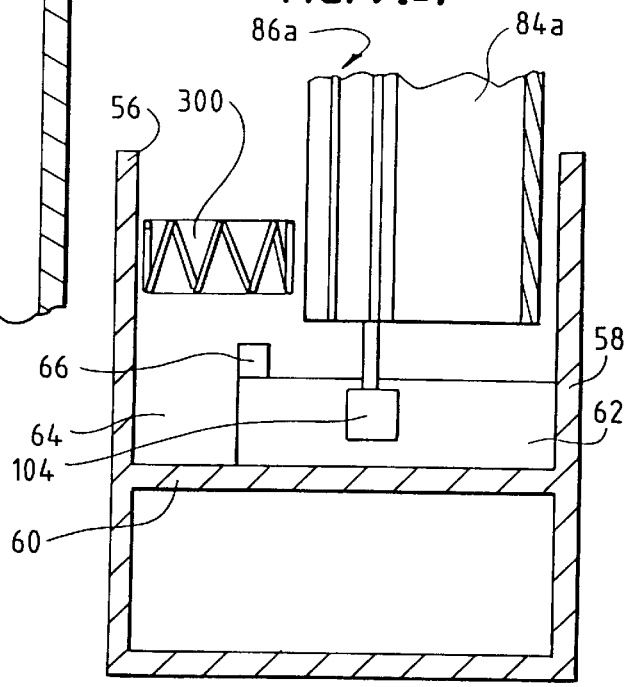
Figure 10A:
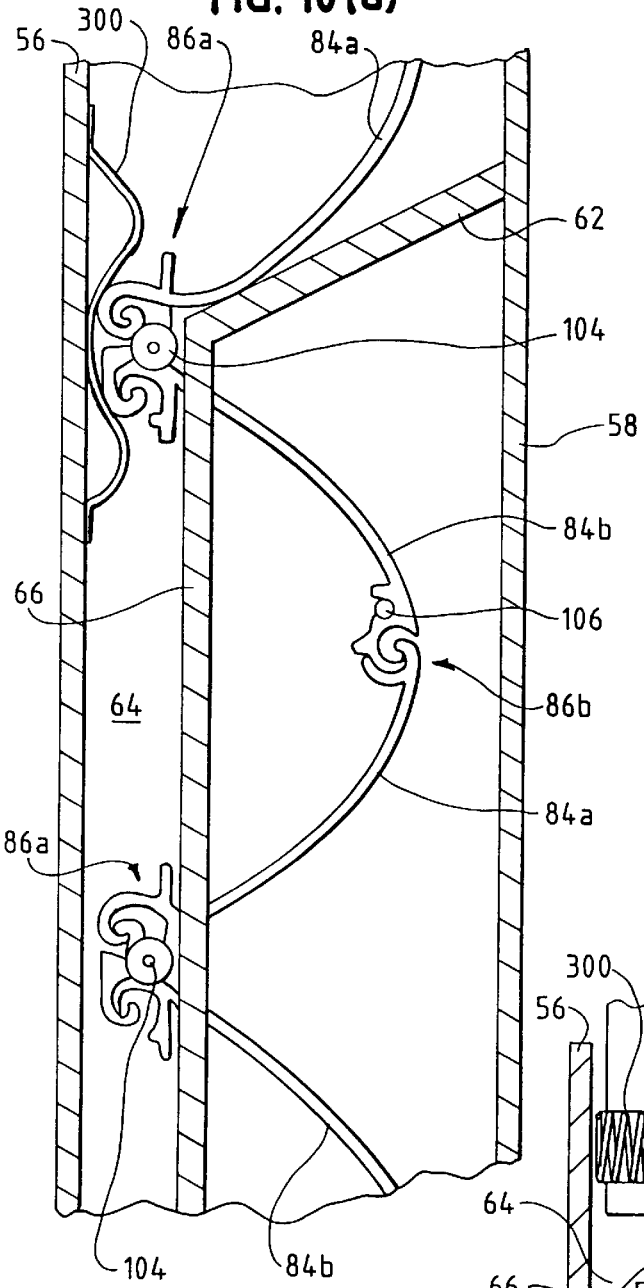
FIGS. 10(*a*) and (*b*) are partial side and top sectional views of a shutter assembly utilizing a spring member for deployment control according to the present invention in a second position.
Figure 10B:
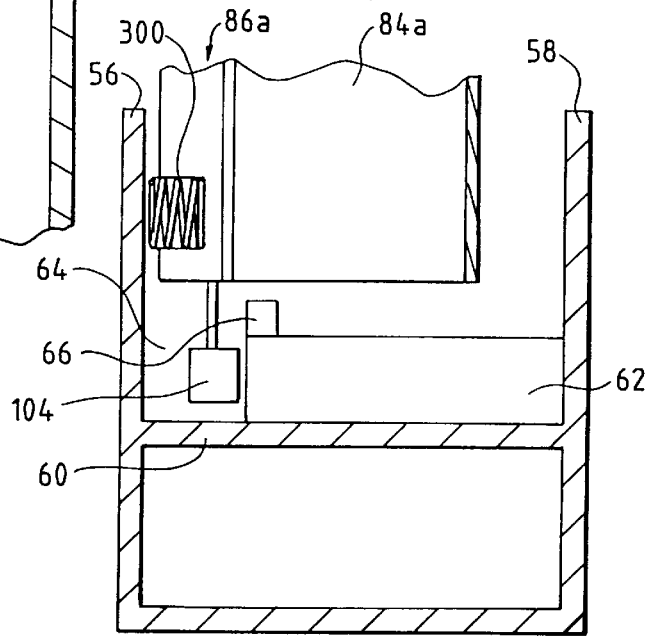
Figure 11A:
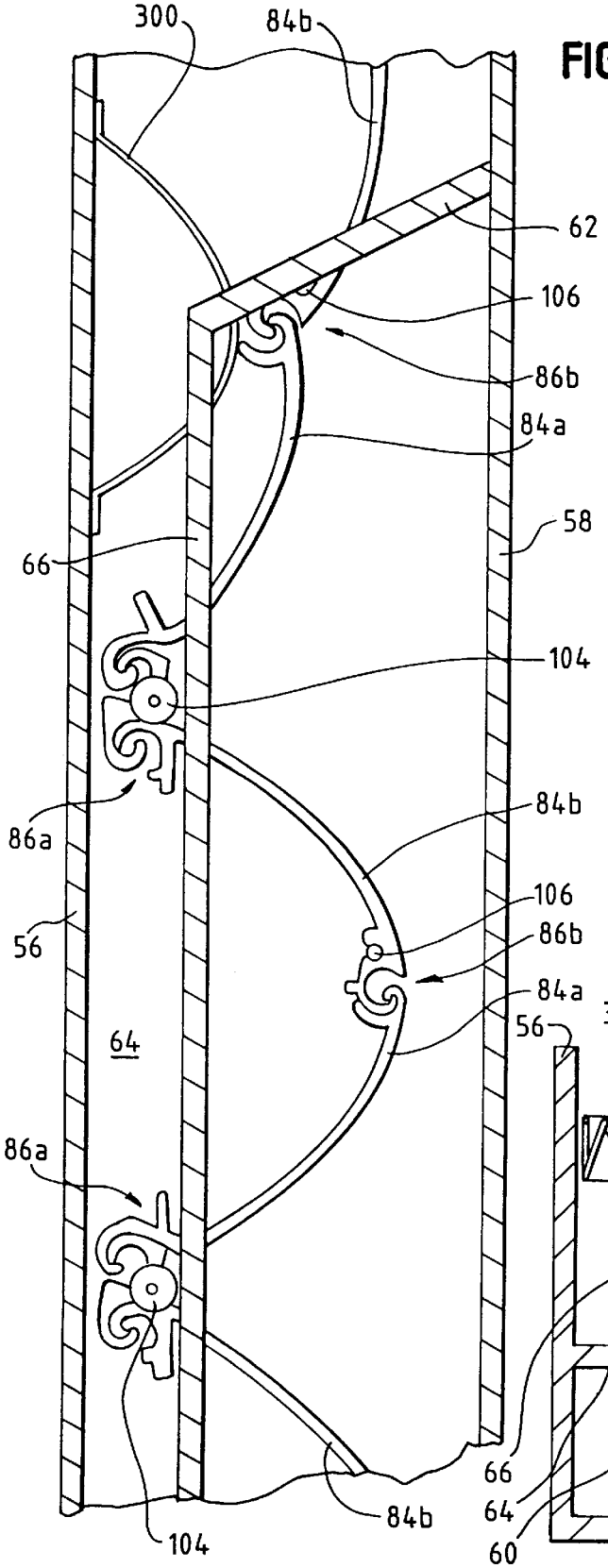
FIGS. 11(*a*) and (*b*) are partial side and top sectional views of a shutter assembly utilizing a spring member for deployment control according to the present invention in a third position.
Figure 11B:
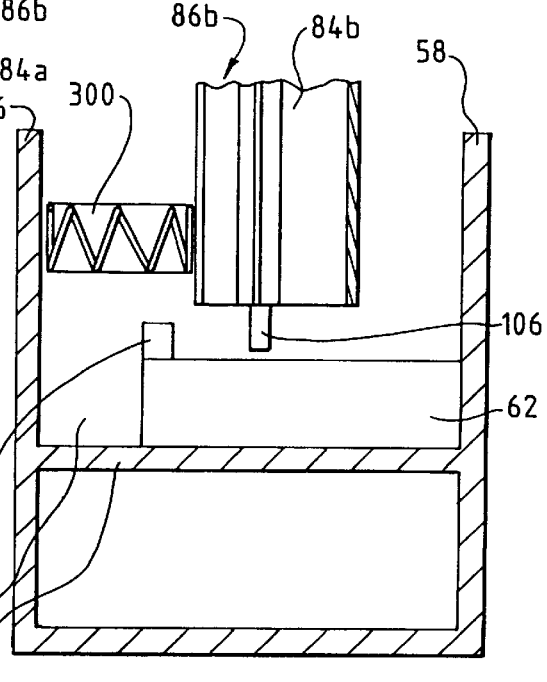

The shutter track 40 may further include a spring member 300 attached to the side wall 56 proximate the intersection of the plate 62 and the guide wall 66. The spring member 300 assists in directing the pins 106 to the outside of the guide channel 64. Examples of the spring member 300 are illustrated in FIGS. 9–11. As shown in FIG. 9(*a*), the spring member 300 is formed from a strip of spring steel attached to the side wall 56 such that the spring member 300 forms a bow shape. The spring member 300 extends across the guide channel 64 and beyond the guide wall 66. The spring member 300 is mounted on the side wall 56 beyond the end of the guide wall 66 as shown in FIG. 9(*b*).

Referring to FIGS. 10(*a*) and (*b*), the plate 62 forces the roller 104 toward the guide channel 64. As the roller 68 approaches the guide channel 64, the spring member 300 engages the hinge 86*a* and slat 84*a*. The spring member 300 has enough elasticity that the force exerted by the plate 62 on the roller 104 in the direction of the side wall 56 is sufficient to cause deflection of the spring member 300 in the direction of the side wall 56. The deflection of the spring member 300 allows the roller 104 to continue to move along the plate 62 and into the guide channel 64 as shown in FIGS. 10(*a*) and (b). As the roller 104 moves past the spring member 300, the spring member 300 returns to its initial shape.

Conversely, the spring member 300 prevents the pin 106 from entering the guide channel 64, as illustrated in FIGS. 11(*a*) and (*b*). Because the pin 106 is not engaged by the plate 62, the pin 106 does not have a force directing it towards the side wall 56. The spring member 300 is stiff enough to prevent deflection when engaged by one of the hinges 86*b*. In this way, the spring member 300 ensures that the hinges 86*a* are disposed on one side of the guide wall 66 and the hinges 86*b* are disposed on the other side of the guide wall 66, thus forming the desired V-shape.

Figure 12A:
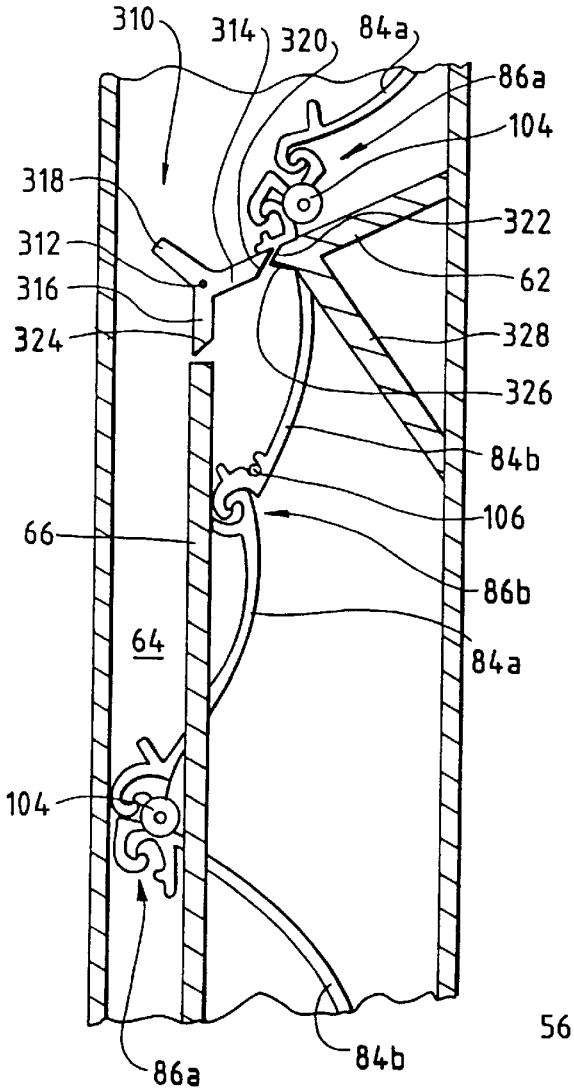
FIGS. 12(*a*) and (*b*) are partial side and top sectional views of a shutter assembly utilizing a gate for deployment control according to the present invention in a first position.
Figure 12B:
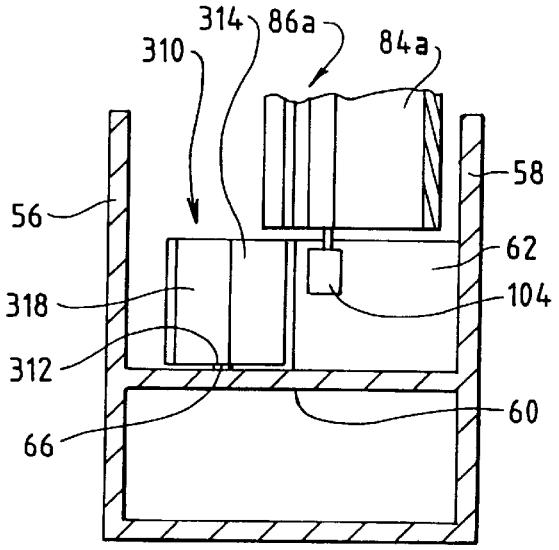

Another alternative for disposing the hinges 86*a* on one side of the guide wall 66 and the hinge 86*b* on the other side of the guide wall 66 is shown in FIGS. 12–15. Referring to FIGS. 12(*a*) and (*b*), the plate 62 and side wall 66 do not intersect. Rather, a gate 310 is provided which will control the distribution of the hinges 86 on either side of the guide wall 66. The gate 310 is pivotally connected to the end wall 60 at a pivot point 312, with a first arm 314, a second arm 316, and a third arm 318 equally spaced about the pivot point 312. The first arm 314 includes a first gate stop surface 320 which engages a first plate surface 322 to limit the rotation of the gate 310 in the clockwise direction. The second arm 316 further includes a second gate stop surface 324 which engages a second plate surface 326 on the plate 62 to limit the counterclockwise rotation of the gate 310.

Figure 13A:
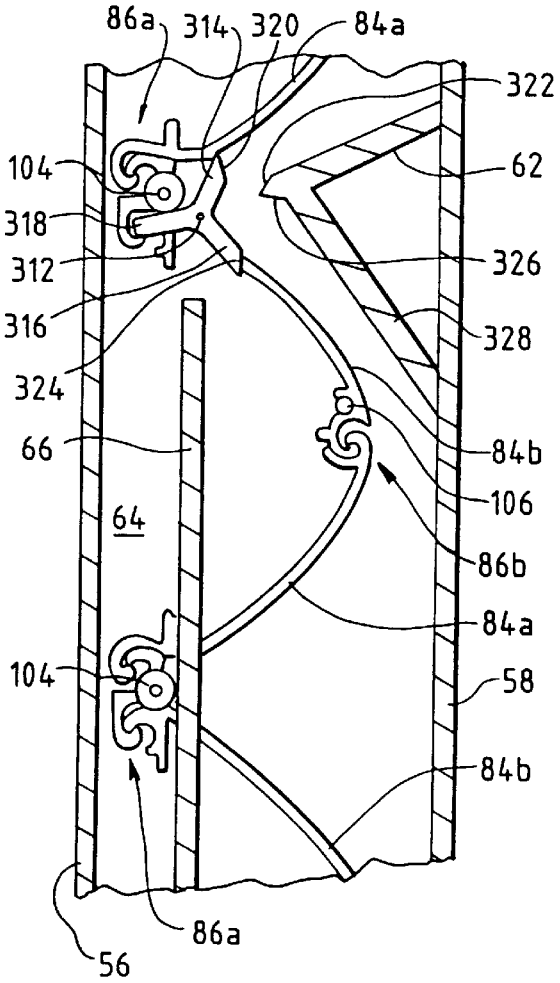
FIGS. 13(*a*) and (*b*) are partial side and top sectional views of a shutter assembly utilizing a gate for deployment control according to the present invention in a second position.
Figure 13B:
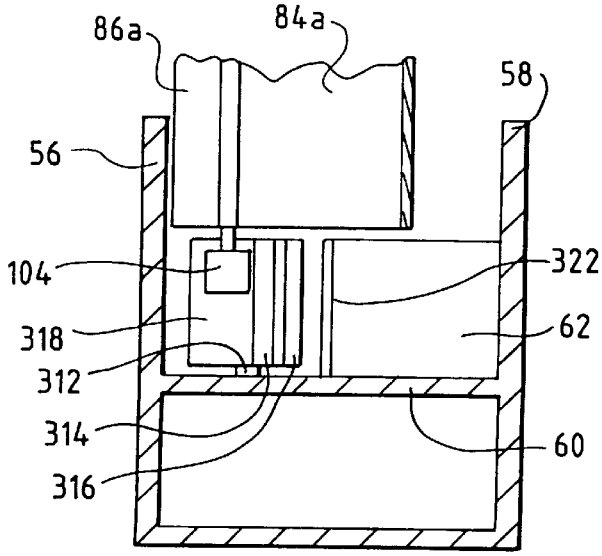

As the shutter 30 is deployed, one of the rollers 104 is engaged by the plate 62 and directed towards the guide channel 64. When the roller 104 comes into contact with the arm 314, the first plate surface 322 prevents the gate 310 from rotating in the clockwise direction. The roller 104 continues to move along the arm 314 until it reaches the arm 318. The force exerted by the roller 104 on the arm 318 causes the gate to rotate in the counterclockwise direction, as shown in FIGS. 13(*a*) and (*b*). The gate 310 continues to rotate in the clockwise direction until the second gate stop surface 324 is engaged by the second plate surface 326, as shown in FIGS. 14(*a*) and (*b*).

Figure 14A:
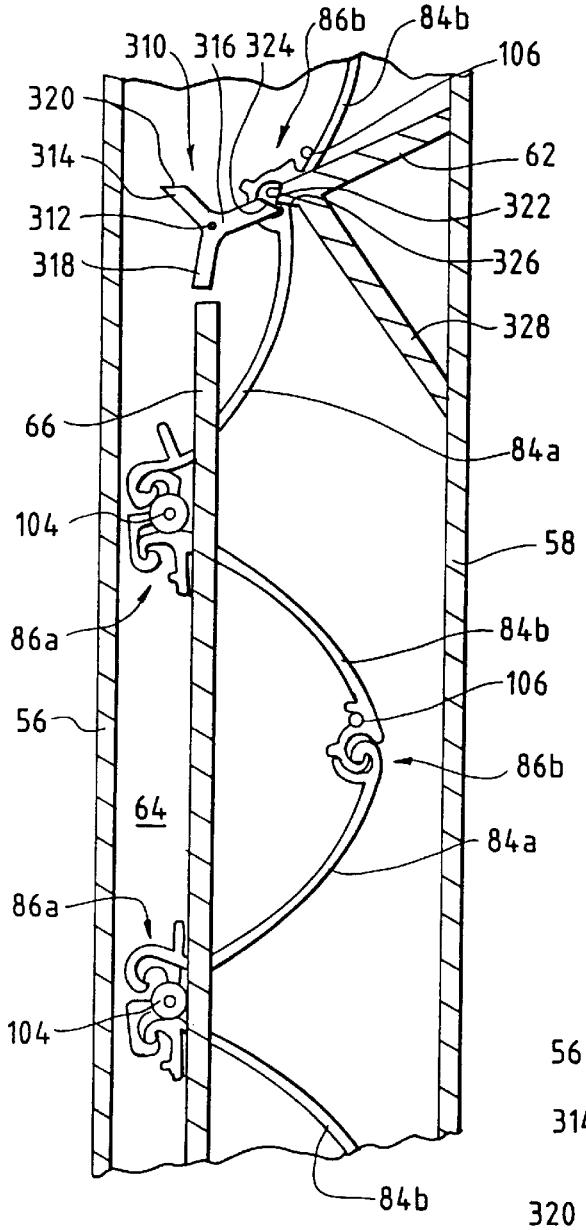
FIGS. 14(*a*) and (*b*) are partial side and top sectional views of a shutter assembly utilizing a gate for deployment control according to the present invention in a third position.
Figure 14B:
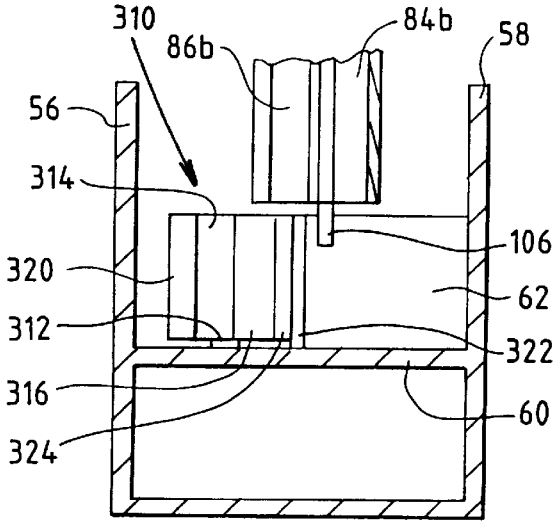
Figure 15A:
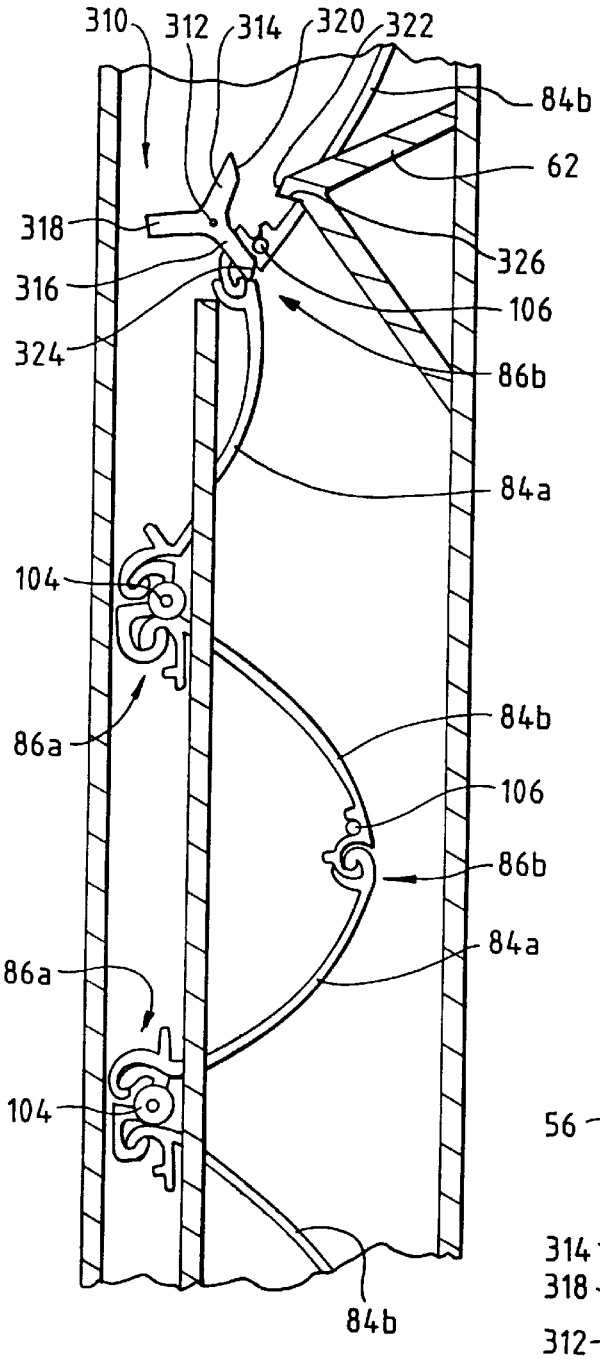
FIGS. 15(*a*) and (*b*) are partial side and top sectional views of a shutter assembly utilizing a gate for deployment control according to the present invention in a fourth position.
Figure 15B:
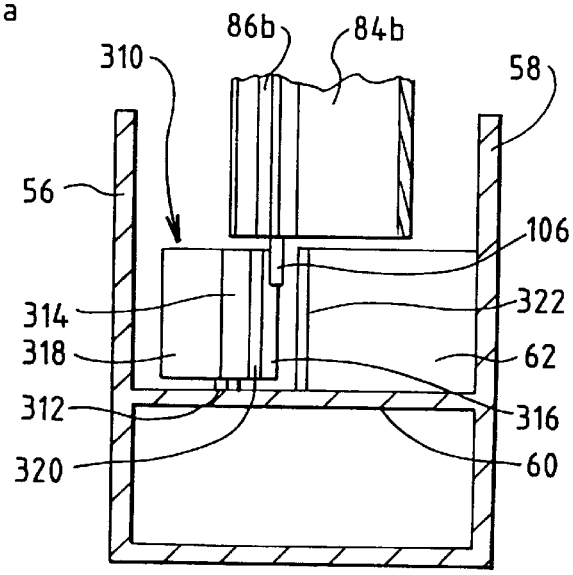

In this configuration, the plate 62 engages the pins 106 (FIG. 14(*b*)), thereby directing the pins 106 toward the gate 310. When one of the pins 106 engages the arm 316, the gate 310 is free to rotate in the clockwise direction, as shown in FIGS. 15(*a*) and (*b*). The pin 106 causes the gate 310 to rotate in the clockwise direction until the first gate stop surface 320 is engaged by the first plate surface 322. After the pin 106 is past the gate 310 and disposed on the outside of the guide channel 64, the gate 310 is in position to direct the next roller 104 into the guide channel 64 as shown in FIG. 12(*a*).

When the shutter 82 is rolled up, the gate 310 again toggles between the two positions as the rollers 104 and the pins 106 move in the upward direction. The pins 106 engage the arm 314 when the gate 310 is in the position shown in FIG. 12(*a*). The gate 310 rotates in the counterclockwise direction until the second gate stop surface 324 is engaged by the second plate surface 326 as shown in FIG. 14(*a*). As the rollers 104 pass the gate 310, the rollers 104 engage the arm 314 causing the gate 310 to rotate in the clockwise direction until the first gate stop surface 320 is engaged by the first plate surface 322, as shown in FIG. 12(*a*). A return plate 328 may be provided if necessary to direct the pins 106 toward the gate 310 as they move in the upward direction.

Figure 16A:
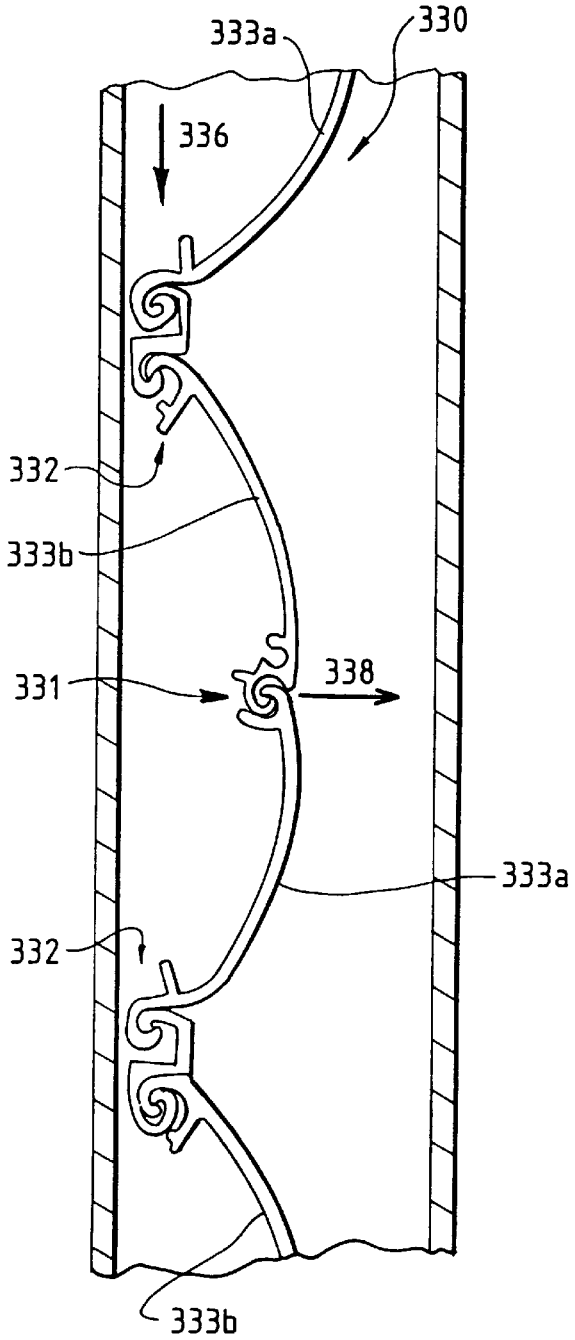
FIGS. 16(*a*) and (*b*) are partial side sectional views of a shutter assembly having a hinge with restricted rotation according to the present invention.
Figure 16B:
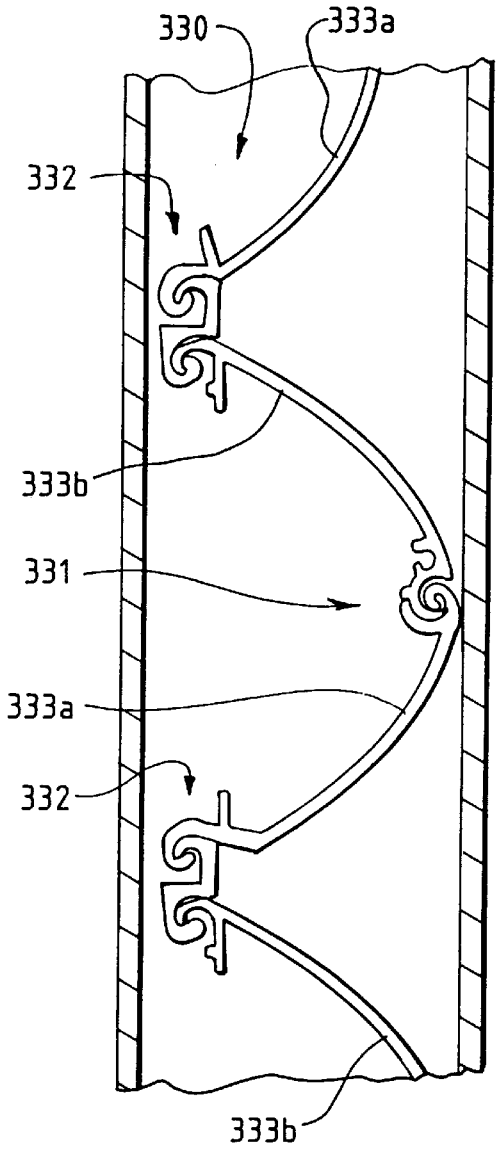
Figure 17A:
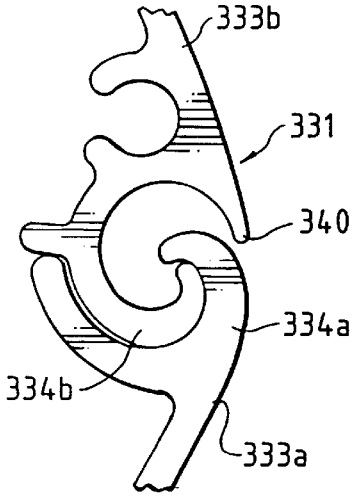
FIGS. 17(*a*)–(*c*) are partial side views of hinges with restricted rotation according to the present invention.
Figure 17B:
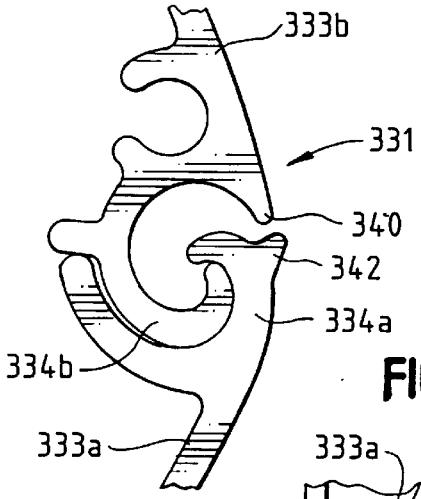
Figure 17C:
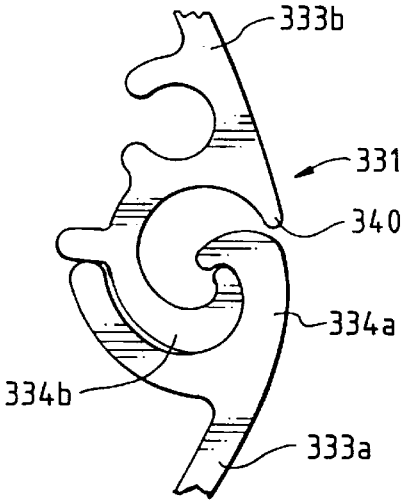
Figure 17D:
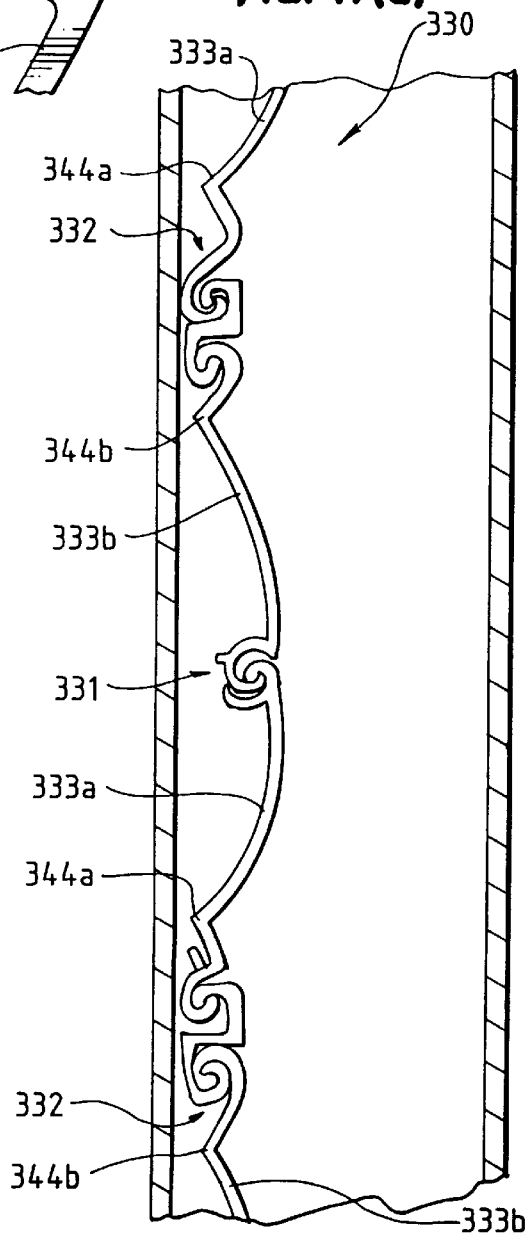

In an alternative embodiment, the desired V-shape for a shutter is achieved without a plate and guide wall by restricting the rotation of the hinges so that a given hinge does not align with the adjacent hinges. FIGS. 16(*a*) and (*b*) illustrate a portion of a shutter 330 having hinges 331 with restricted rotation. The hinges 331 are alternated with hinges 332 to facilitate the V-shape of the shutter 330 in the deployed position. As shown in FIG. 16(*a*), as the shutter 330 is unrolled, the restricted rotation of the hinges 331 prevents the hinges 331 from aligning with the adjacent hinges 332. As the bottom most slat 333 reaches the bottom of the side track 334, the weight of the upper slats 333 forces the upper hinges 332 toward the lower hinge 332. With the rotation of hinge 331 restricted as described, the slats 333 are forced to collapse into the desired V-shape as shown in FIG. 16(*b*).

The rotation of the hinge 331 can be restricted in several alternative methods as shown in FIGS. 17(*a*)–(*d*). Referring to FIG. 17(*a*), the hinge 331 is formed by a first spiral section 334*a* at an end of a slat 333*a* that interconnects a second spiral section 334*b* at an end of a slat 333*b*. A tip portion 340 extends from the slat 333*b* beyond the second spiral section 334*b* and toward the first spiral section 334*a*. By extending the tip portion 340 toward the first spiral section 334*a*, the tip 340 engages the first spiral section 334*a* before the hinge 331 aligns with the adjacent hinges 332. In another alternative embodiment of hinge 331 shown in FIG. 17(*b*), an extrusion 342 on the first spiral section 334*a* engages the tip portion 340 to restrict the rotation of the hinge 331, thereby preventing the hinge 331 from aligning with the adjacent hinges 332.

In yet another embodiment illustrated in FIG. 17(*c*), the rotation of the hinge 331 is restricted by increasing the thickness of the first spiral section 334*a* and the second spiral section 334*b*. In addition to restricting the rotation of the hinge 331, the increased thickness of the spiral sections 334*a*, 334*b* reduces the amount of free play between the slats 333*a*, 333*b*. The reduced free play in this alternative provides the additional benefit of making the deployment of the rolling shutter according to the present invention significantly quieter than the deployment of the previous rolling shutters with vertically aligned slats. In an additional embodiment illustrated in FIG. 17(*d*), the slats 333*a*, 333*b* include bends 344*a*, 344*b*, respectively, proximate the hinges 332. With the bends 344*a*,344*b* provided in the slats 334*a*,334*b* as shown, the hinge 331 does not align with the adjacent hinges 332. In this way, the desired V-shape of the shutter 330 is achieved without the need of a guide channel to assist in shaping the shutter 330 and without restricting the rotation of the hinge 331.

Figure 18A:
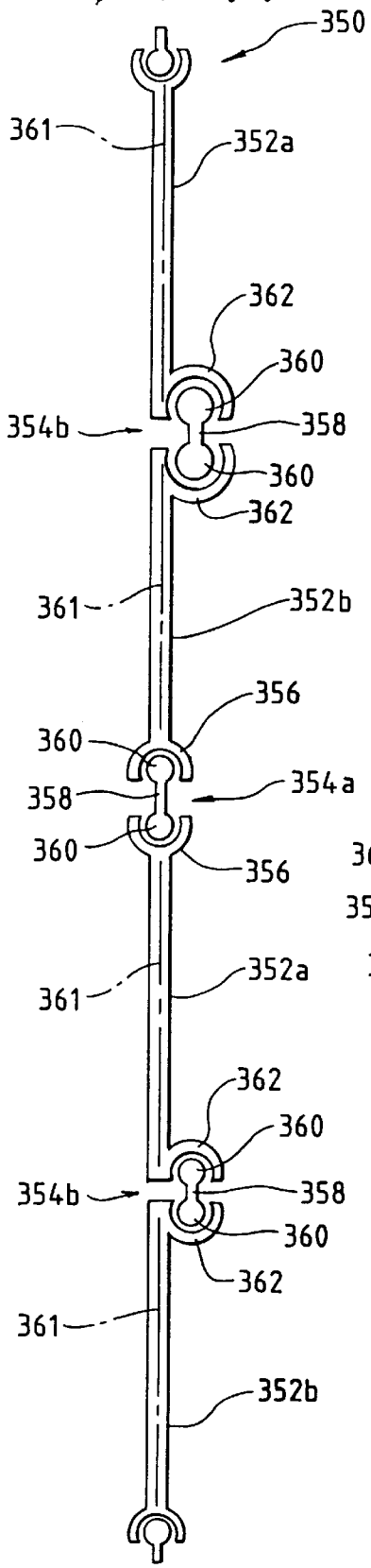
FIGS. 18(*a*)–(*b*) are partial side views of a shutter curtain including hinges configured to force the shape of the shutter curtains according to the present invention.
Figure 18B:
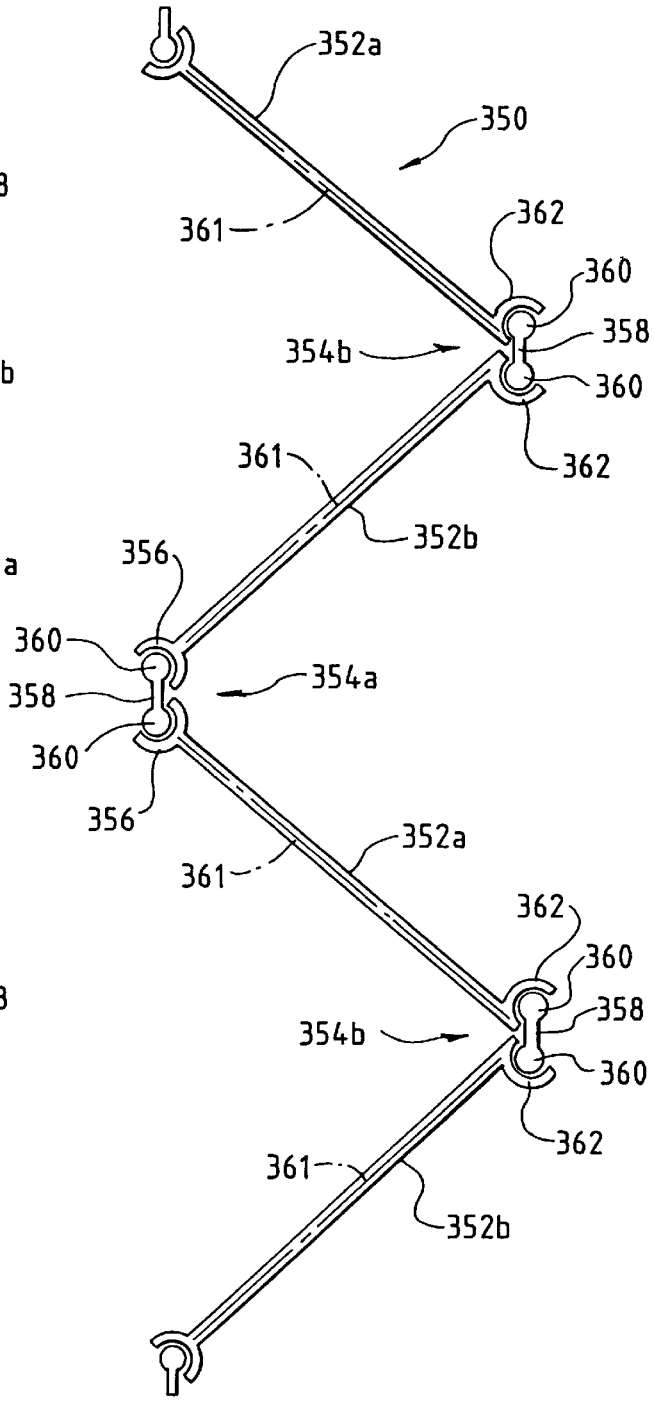
Figure 19A:
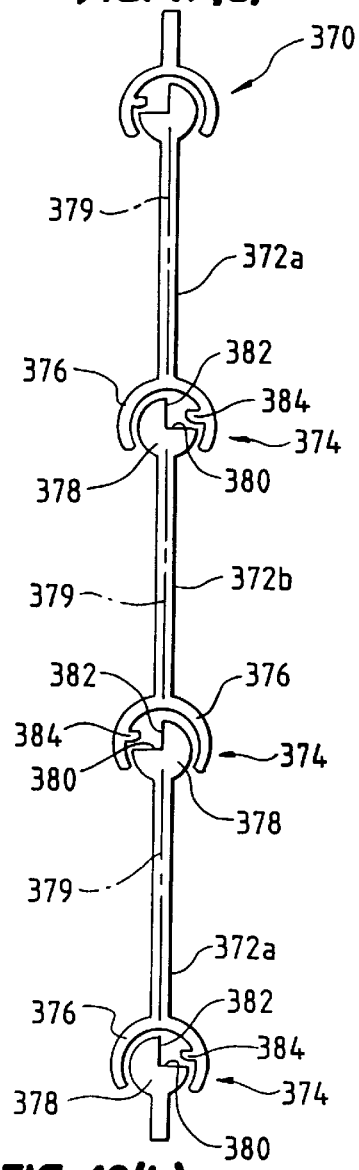
FIGS. 19(*a*)–(*g*) are partial side views of shutter curtains including an alternative embodiment of hinges configured to force the shape of the shutter curtains according to the present invention.
Figure 19E:
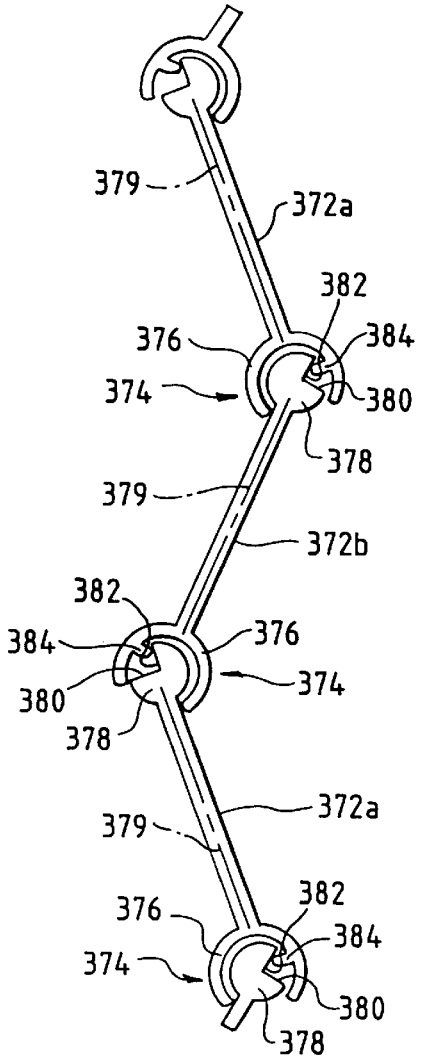
Figure 19B:
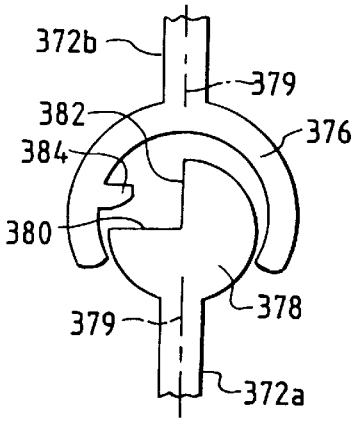
Figure 19C:
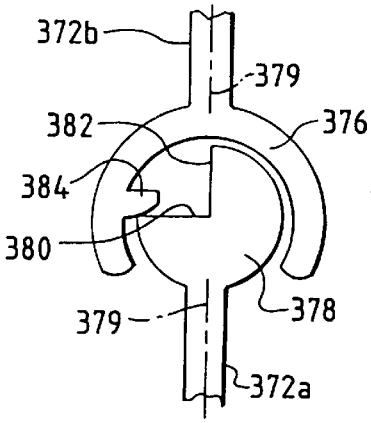
Figure 19D:
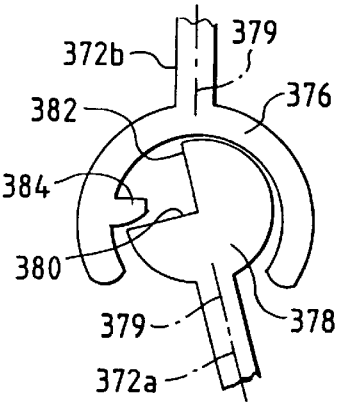
Figure 19F:
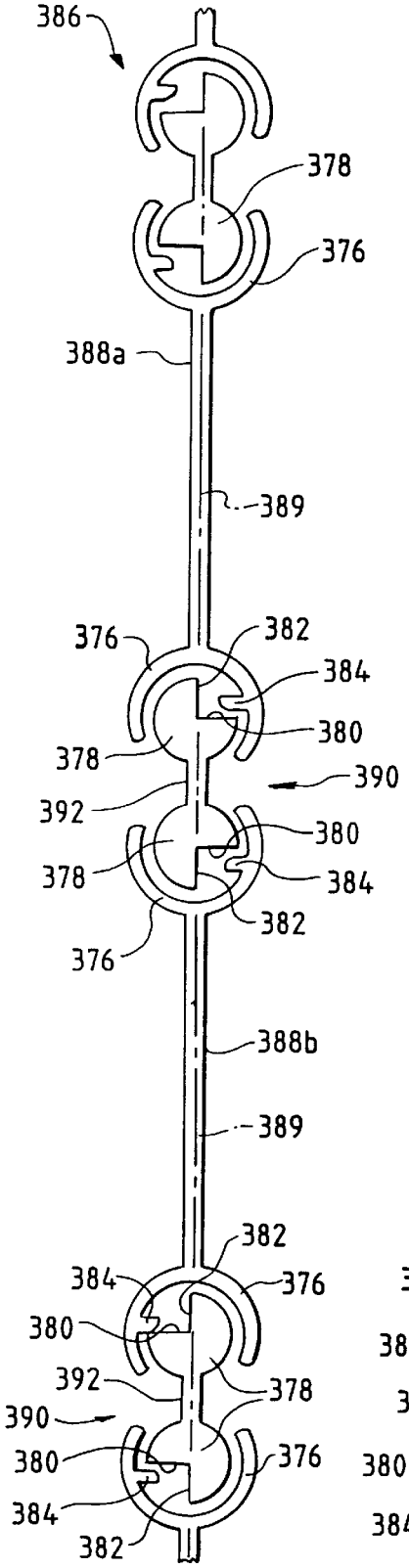
Figure 19G:
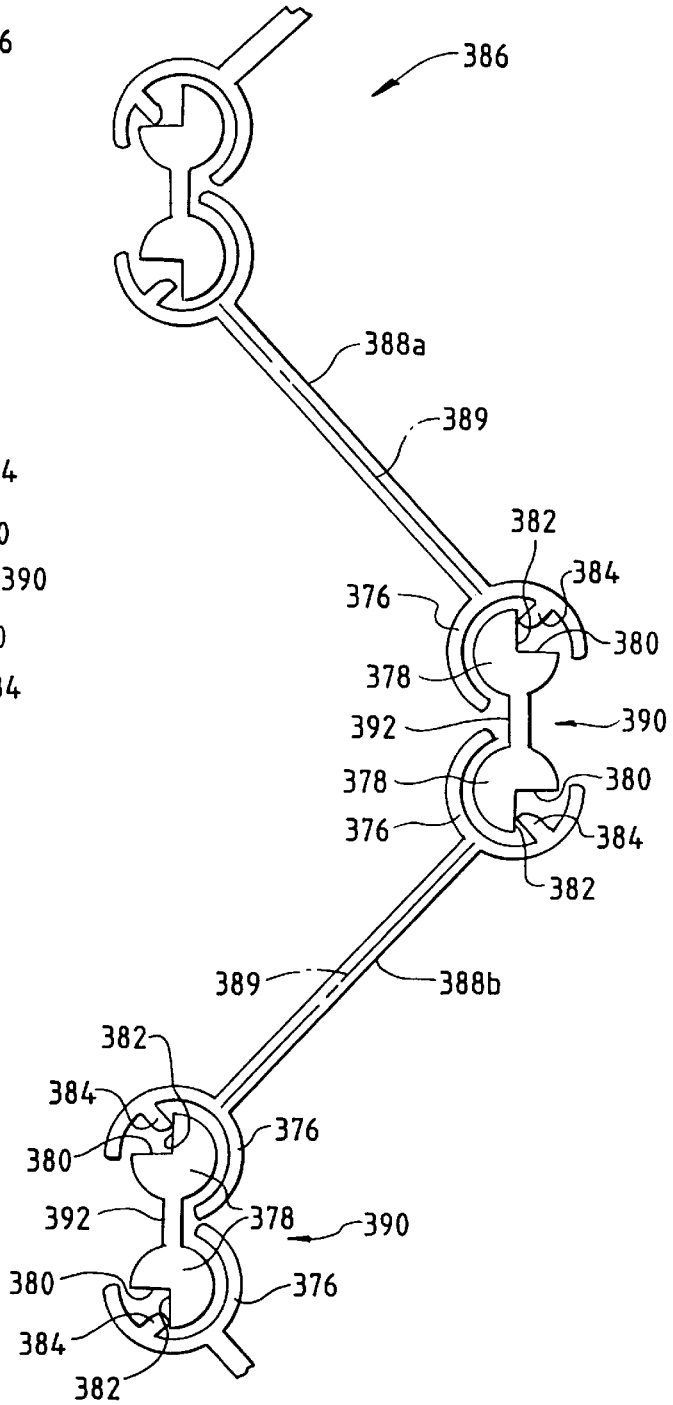
Figure 20A:
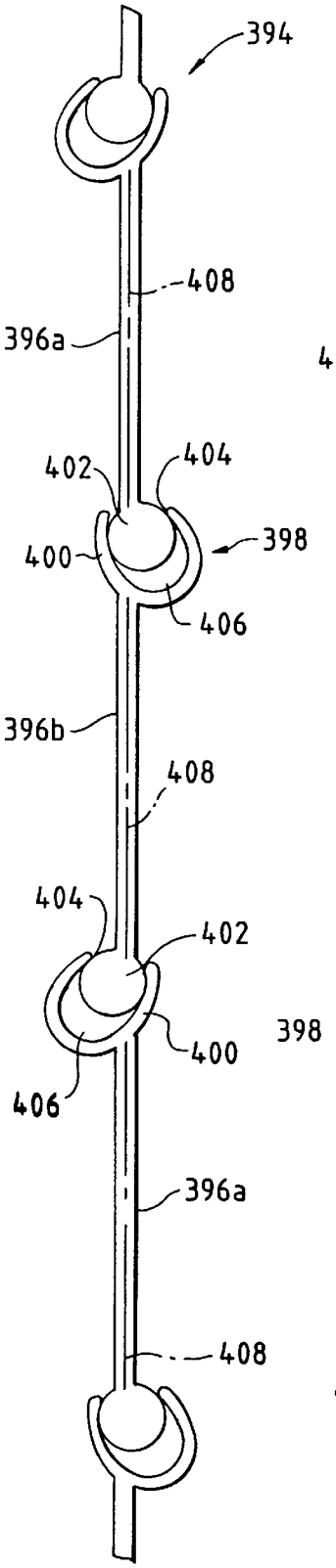
FIGS. 20(*a*)–(*g*) are partial side views of shutter curtains including another alternative embodiment of hinges configured to force the shape of the shutter curtains according to the present invention.
Figure 20B:
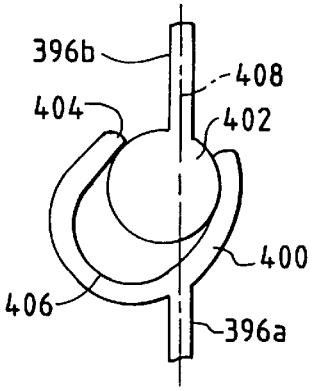
Figure 20C:
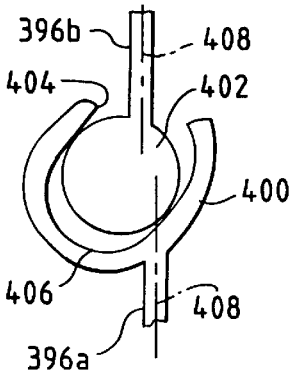
Figure 20D:
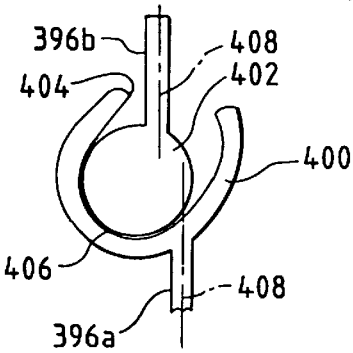
Figure 20E:
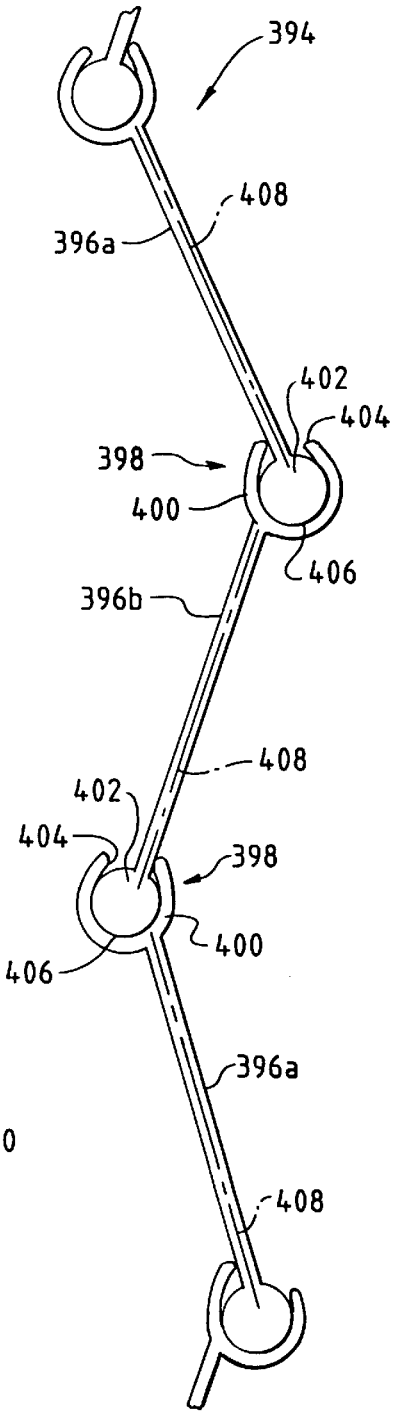
Figure 20F:
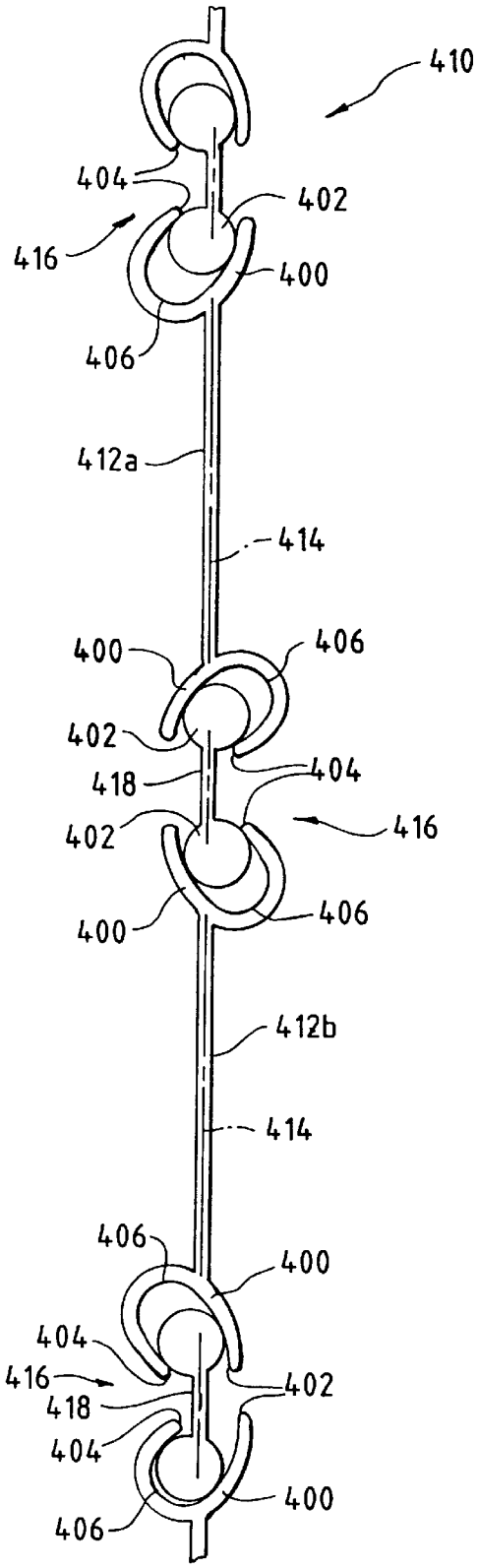
Figure 20G:
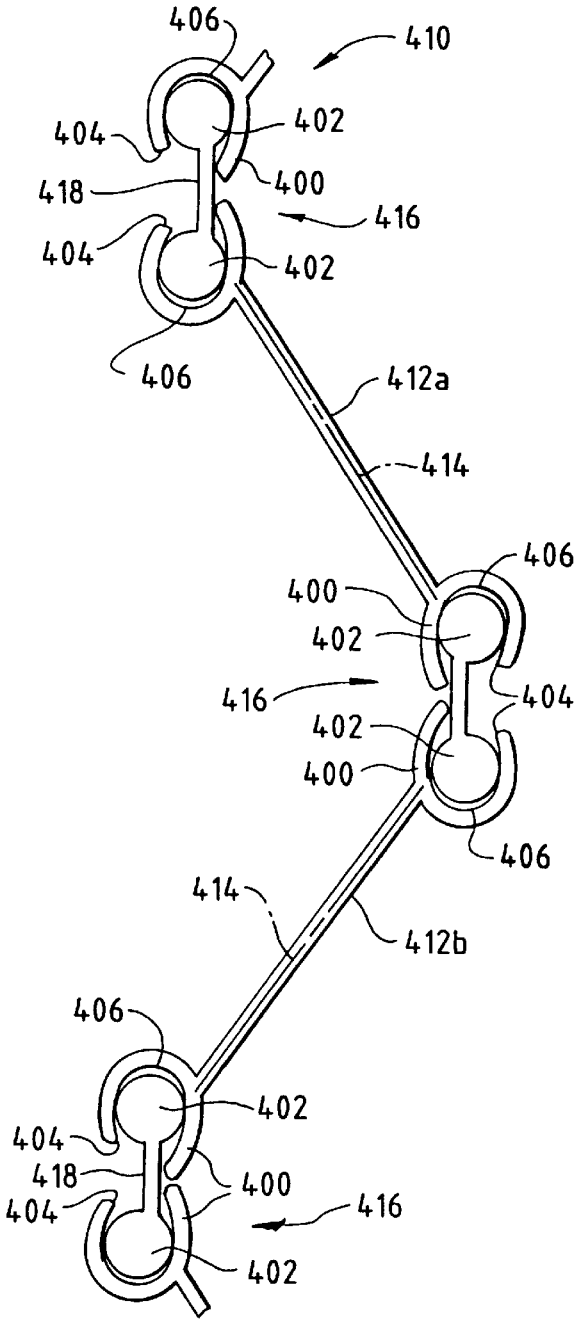
Figure 21A:
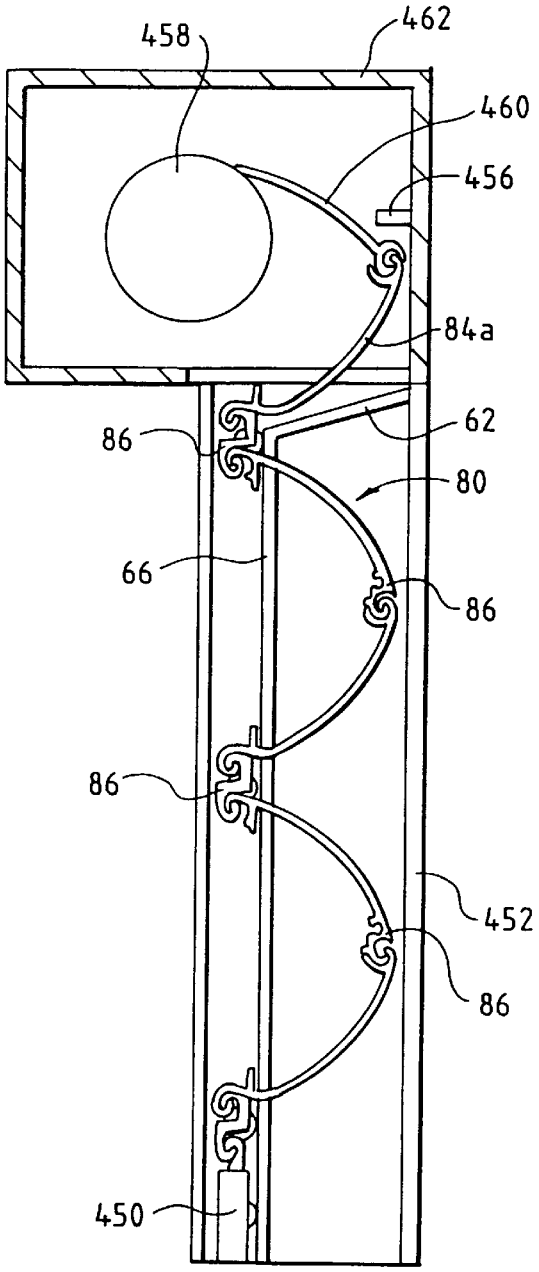
FIGS. 21(*a*)–(*h*) are partial side schematic views of shutter assemblies according to the present invention adapted to accommodate side tracks of varying lengths.
Figure 21B:
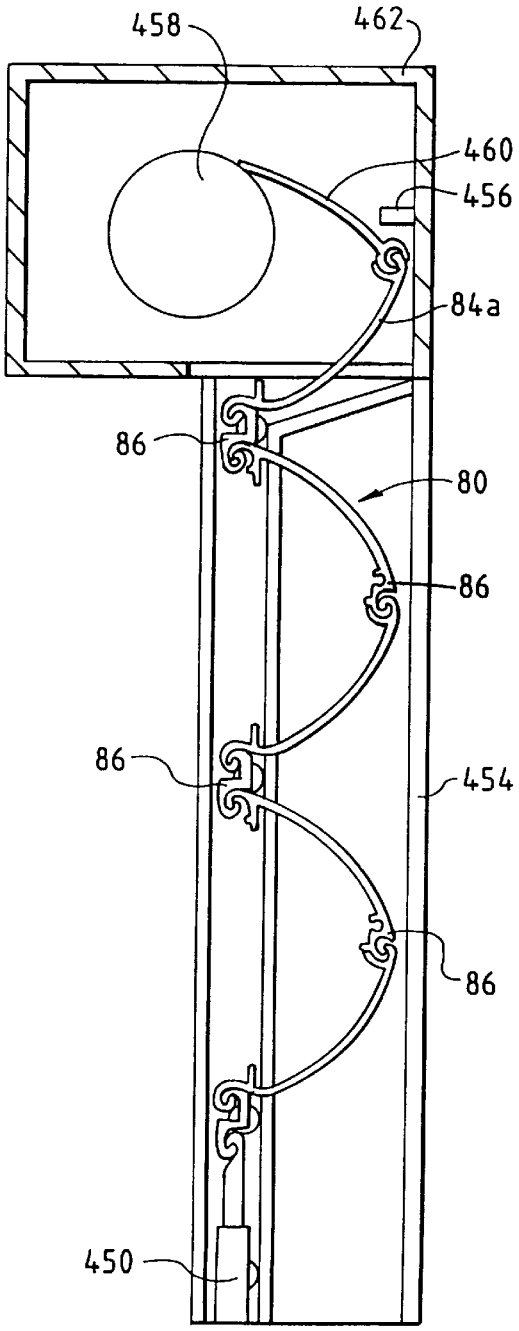
Figure 21C:
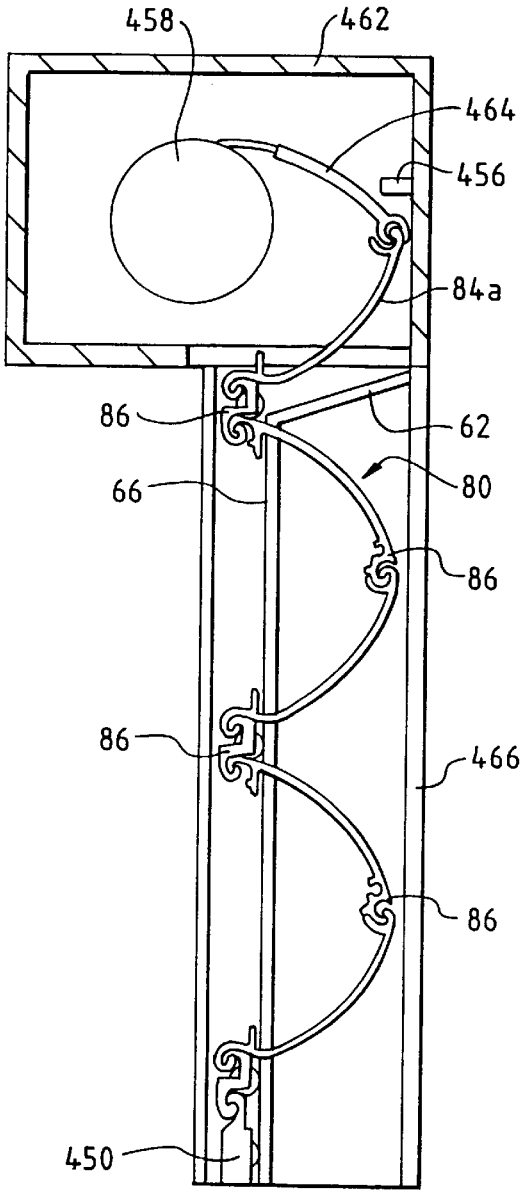
Figure 21D:
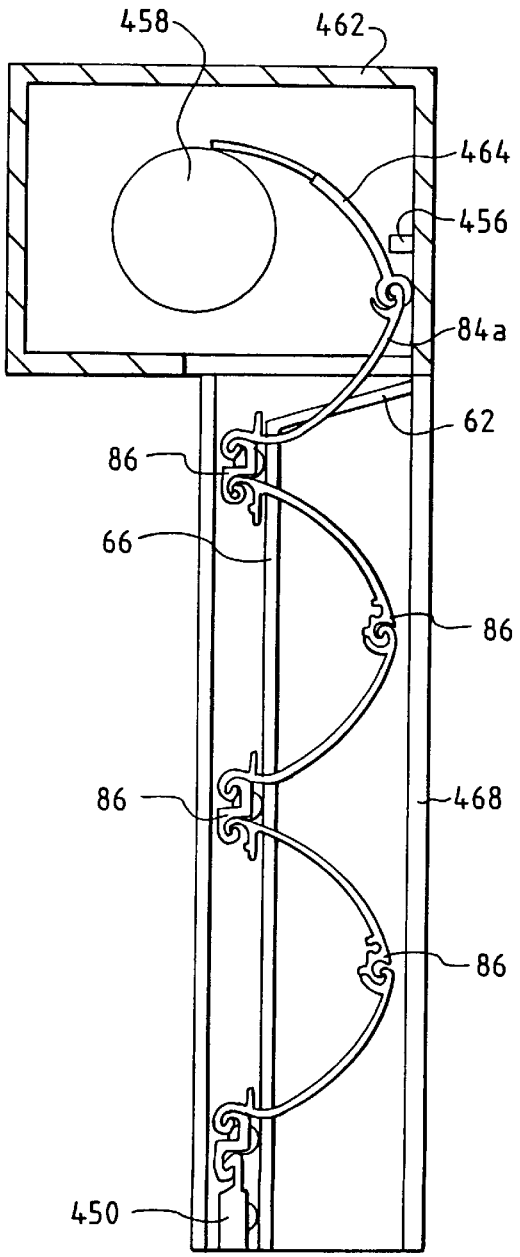
Figure 21E:
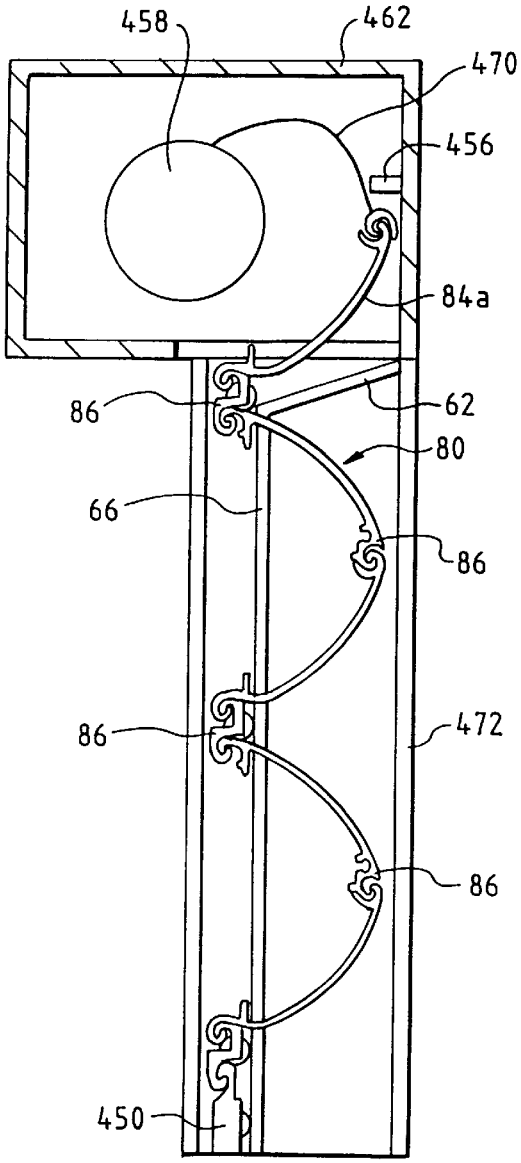
Figure 21F:
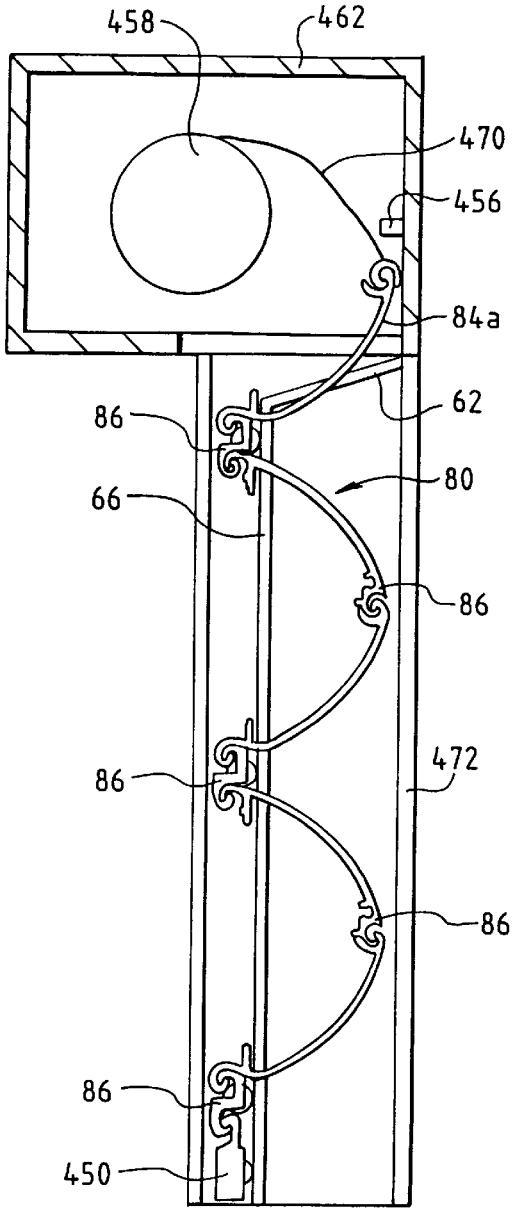
Figure 21G:
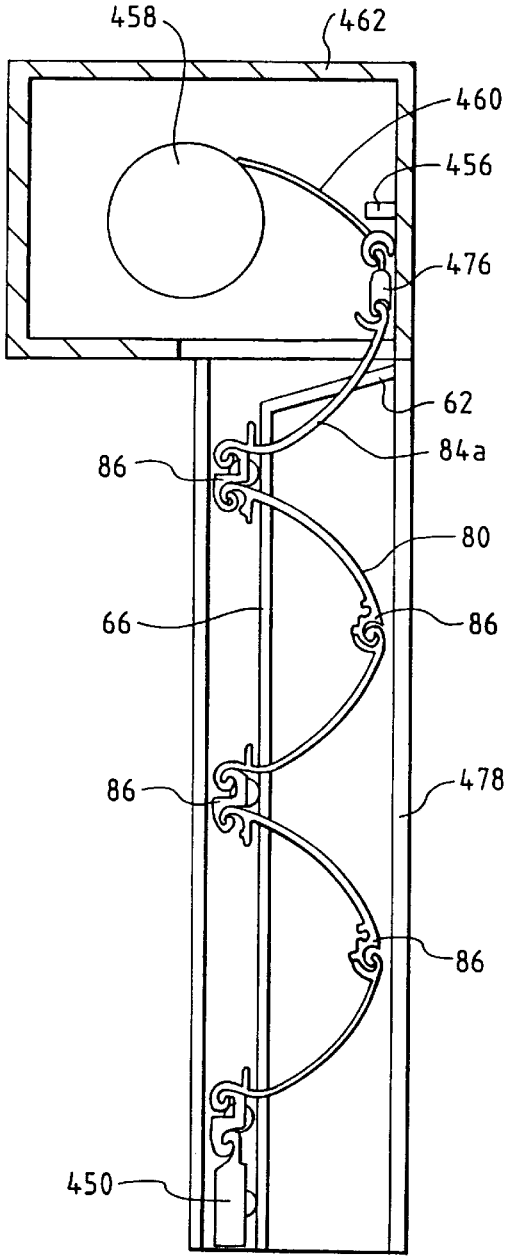
Figure 21H:
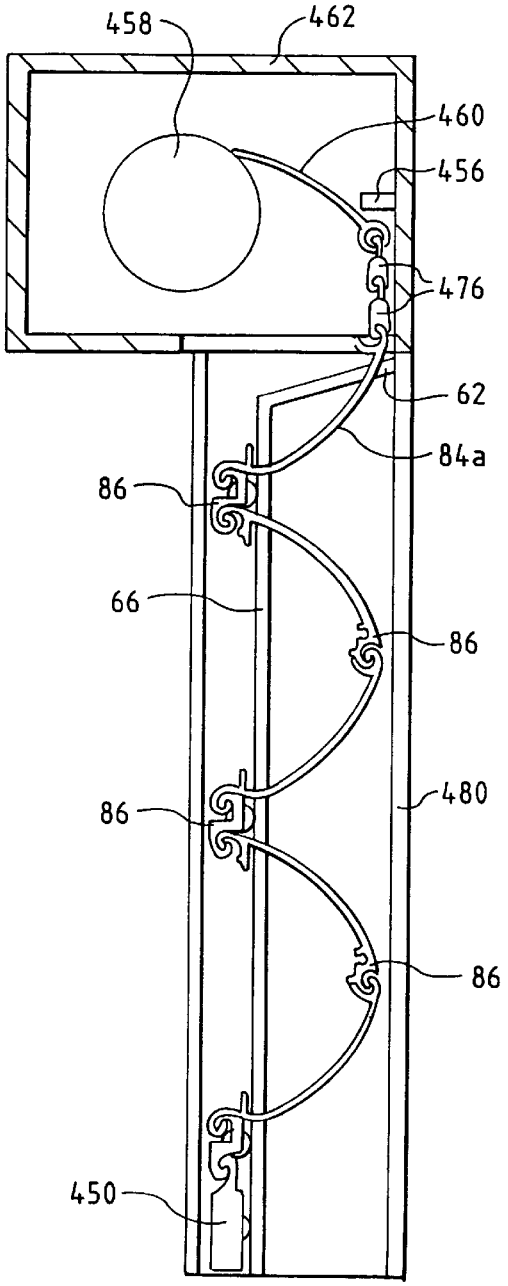

The desired shutter shape may also be implemented by configuring some or all of the hinges to rotate in the proper direction as the weight of the upper slats compresses the shutter curtain, thereby forcing the proper shape of the shutter curtain. One example of this type of hinge configuration is shown in FIGS. 18(*a*) and (*b*). FIG. 18(*a*) illustrates a shutter curtain 350 having a plurality of slats 352 divided into a first set of slats 352*a* and a second set of slats 352*b* alternated with the first set of slats 352*a*. The shutter 350 has a plurality of elongated hinges 354 connecting the slats 352 and divided into a first set of hinges 354*a* and a second set of hinges 354*b* alternated with the first set of hinges 354*a*. Each of the hinges 354*a* of the first set is composed of a pair of semi-circular members 356 with sockets formed therein, each of which is integrally formed with one of the adjoining slats 352, and a link 358 having a pair of parallel circular rods 360 integrally formed therewith and pivotally disposed within one of the socket members 356. Since the socket members 356 cover slightly over half of the diameter of the rods 360, the rods 360 are permanently retained within the socket members 356. Additionally, the socket members 356 are formed with the slats 352 so that the radius of curvature of the socket members 356 and the longitudinal axis of the retained rods 360 lie along a centerline 361 of the associated slats 352.

Each of the hinges 354*b* of the second set is composed of a pair of semicircular members 362 with sockets formed therein, each of which is integrally formed with one of the adjoining slats 352, and one of the links 358 with each of the rods 360 pivotally disposed within one of the socket members 362. Since the socket members 362 cover slightly over half of the diameter of the rods 360, the rods 360 are permanently retained within the socket members 362. Additionally, the socket members 362 are formed with the slats 352 so that the radius of curvature of the socket members 362 and the longitudinal axis of the retained rods 360 are offset from the centerline 361 of the associated slats 352, with each of the hinges 354*b* of the second set offset on the same side of the shutter curtain 350.

With the hinges 354*b* of the second set offset from the centerlines 361 of the adjoining slats 352, the hinges 354*b* of the second set force the slats 352 to rotate in the proper direction to form the desired shutter shape. As the shutter curtain 350 is unrolled toward the deployed position, the weight of the slats 352 causes substantial vertical alignment of the centerlines 361 of the slats 352 and the hinges 354*a* of the first set with the hinges 354*b* of the second set offset from centerlines 361 of the slats 352 and the hinges 354*a* of the first set. When the bottommost slat 352 reaches the base of the shutter tracks, the weight of the upper slats 352 forces the lower slats 352 to compress at the hinges 354. At the hinges 354*b* of the second set, the compressive force causes the slats 354*a* to rotate counterclockwise and the slats 354*b* to rotate clockwise as shown in FIG. 18(*b*). As the shutter curtain 350 is unrolled to the full deployment position, each of the hinges 354*b* of the second set has forced the adjoining hinges 352 to rotate into the proper position as shown in FIG. 18(*b*). In an alternative embodiment, the hinges 354*a* of the first set may be offset from the centerlines 361 of the associated slats 352 on the opposite side of the centerlines 361 as the hinges 354*b* of the second set, thereby forcing the rotation of the hinges 354*a* in the proper direction.

FIGS. 19(*a*)–(*g*) illustrate an alternative hinge configuration which forces the shutter slats to rotate in the proper direction to form the desired shape. Referring to FIG. 19(*a*), a shutter 370 has a first set of slats 372*a* and a second set of slats 372*b* alternated with the first set of slats 372*a*. The slats 372 are interconnected by a plurality of hinges 374, each of which is composed of a semi-circular member 376 with a socket formed therein and a rod 378 pivotally disposed in the socket member 376, with the socket members 376 and the rods 378 being integrally formed with the associated slats 372. The rods 378 are substantially circular with a groove cut out along the longitudinal axis thereof such that a first and a second surface 380, 382 are defined. Since the socket members 376 cover over half of the diameter of the rods 378, the rods 378 are permanently retained within the socket members 376. The socket members 376 and the rods 378 are aligned with the centerlines 379 of the associated slats 372 so that the shutter 370 is substantially vertically aligned as the shutter 370 is unrolled toward the deployed position.

Each of the socket members 376 is dimensioned with an internal diameter slightly larger than an outer diameter of a rod 378, and includes a member 384 that extends inwardly into the socket member 376 on one side of the centerline 379 of the slat 372. The member 384 is disposed between the first and the second surfaces 380, 382 of the rod 378. When the shutter 370 is being unrolled as shown in FIG. 19(*a*), the member 384 is separated from the first surface 380 such that the hinge 374 can rotate in both directions to facilitate rolling and unrolling of the shutter 370 (FIG. 19(*b*)). As the bottommost slat 372 reaches the base of the side tracks, the weight of the slats 372 begins to compress the hinges 374, thereby causing the member 384 to engage the first surface 380 (FIG. 19(*c*)). The engagement by the member 384 causes the rod 378 and, consequently the associated slat 372, to rotate about the member 384 (FIG. 19(*d*)). By alternating the position of the members 384 and the wedge-shaped section of the rods 378 in the hinges 374, each of the slats 372*a* of the first set will rotate counterclockwise and each of the slats 372*b* of the second set will rotate clockwise, thereby resulting in the shutter 370 forming the desired shape as shown in FIG. 19(*e*).

Although the rod 378 is illustrated as having generally wedge-shaped groove and defining essentially planar surfaces 380, 382, other groove geometries that define planar or non-planar surfaces are possible. Additionally, the first and second surfaces 380, 382 may, in the alternative, be defined by a pair ribs on the external surface of the rod 378. Other configurations for providing surfaces 380, 382 that engage the member 384 as described herein will be obvious to those of ordinary skill in the art and are contemplated by the inventor as having use with the present invention.

FIGS. 19(*f*) and (*g*) illustrate an alternative embodiment of a shutter 386 using socket members 376 and rods 378 as discussed in relation to FIGS. 19(*a*) and (*e*). Referring to FIG. 19(*e*), the shutter 386 has a first set of slats 388*a* and a second set of slats 388*b* alternated with the first set of slats 388*a*. Each of the slats 388 includes a pair of socket members 376 integrally formed at opposite ends of the slat 388 and having the associated members 382 disposed on opposite sides of the centerline 389 of the slat 388. The slats 388 are interconnected by plurality of hinges 390, each of which is composed of a socket member 376 of each of the adjoining slats 388 having the members 382 aligned on the same side of the centerlines 389 of the slats 388, and a link 392 having a pair of rods 378 integrally formed therewith and each pivotally disposed within one of the socket members 376 with the members 382 disposed between the first and the second surfaces 380, 382.

As the shutter 386 is unrolled toward the deployed position, the slats 388 and the links 392 are substantially vertically aligned as shown is FIG. 19(*e*). As the bottommost slat 388 reaches the bottom of the side tracks, the weight of the upper slats 388 starts to compress the hinges 390. As the hinges 390 compress, the members 384 engage the first surfaces 380 of the rods 378. The configuration of the hinges 390 causes the slats 388*a* to rotate counterclockwise and the slats 388*b* to rotate clockwise, thereby forcing the shutter 386 to form the desired shape as shown in FIG. 19(*g*).

FIGS. 20(*a*)–(*f*) illustrate yet another alternative hinge configuration which forces the shutter slats to rotate in the proper direction to form the desired shape. Referring to FIG. 20(*a*), a shutter 394 has a first set of slats 396*a* and a second set of slats 396*b* alternated with the first set of slats 396*a*. The slats 396 are interconnected by a plurality of hinges 398, each of which is composed of a semi-circular member 400 with an elongated socket formed therein and a circular rod 402 disposed in the socket member 400, with the socket members 400 and the rods 402 being integrally formed with the associated slats 396. The elongated socket members 400 allow the rods 402 disposed therein to slide between open ends 404 and closed ends 406 of the socket members 400, with the open ends 404 of the socket members 400 covering over half of the diameter of the rods 402 to permanently retain the rods 402 within the socket members 400. The socket members 400 and the rods 402 are connected to the associated hinges 398 so that the centerlines 408 of the connected slats 396 are substantially vertically aligned as the shutter 370 is unrolled toward the deployed position and the rods 402 are engage by the open ends 404 of the socket members 400. In the embodiment shown in FIG. 20(*a*), the rods 402 are connected to the slats 396 such that the longitudinal axes of the rods 402 are offset from the centerlines 408 of the slats 396 and the associated socket members 400 are connected to the adjacent slats 396 such that the centerlines 408 are substantially vertically aligned.

When the shutter 394 is being unrolled as shown in FIG. 20(*a*), the hinge 398 can rotate in both directions to facilitate rolling and unrolling of the shutter 394 (FIG. 20(*b*)). As the bottommost slat 396 reaches the base of the side tracks, the weight of the slats 396 begins to compress the hinges 398, thereby causing the rods 402 to slide within the socket members 400 toward the closed ends 406 (FIG. 20(*c*)). As the rods 402 approach the closed ends 406 of the socket members 400, the centerlines 408 of the connected slats 396 are no longer aligned. When the closed ends 406 of the socket members 400 engage the rods 402, the hinges 398 and, consequently the associated slats 396, begin to rotate (FIG. 20(*d*)). By alternating the closed ends 406 of the socket members 400 on either side of the shutter 394, each of the slats 396*a* of the first set will rotate counterclockwise and each of the slats 396*b* of the second set will rotate clockwise, thereby resulting in the shutter 394 forming the desired shape as shown in FIG. 20(*e*).

FIGS. 20(*f*) and (*g*) illustrates an alternative embodiment of a shutter 410 using socket members 400 and rods 402 as discussed in relation to FIGS. 20(*a*)–(*e*). Referring to FIG. 20(*f*), the shutter 410 has a first set of slats 412*a* and a second set of slats 412*b* alternated with the first set of slats 412*a*. Each of the slats 412 includes a pair of socket members 400 integrally formed at opposite ends of the slat 412 and having the associated closed ends 406 disposed on opposite sides of the centerline 414 of the slat 412. The slats 412 are interconnected by plurality of hinges 416, each of which is composed of a socket member 400 of each of the adjoining slats 412 having the closed ends 406 aligned on the same side of the centerlines 414 of the slats 412, and a link 418 having a pair of rods 402 integrally formed therewith and each pivotally disposed and slidable within one of the socket members 400.

As the shutter 410 is unrolled toward the deployed position the slats 412 and the links 418 are substantially vertically aligned as shown is FIG. 20(*e*). As the bottommost slat 412 reaches the bottom of the side tracks, the weight of the upper slats 412 starts to compress the hinges 416. As the hinges 416 compress, the rods 402 slide toward and are engaged by the closed ends 406 of the socket members 400. The configuration of the hinges 416 causes the slats 412*a* to rotate counterclockwise and the slats 412*b* to rotate clockwise, thereby forcing the shutter 410 to form the desired shape as shown in FIG. 20(*f*).

Figure 7:
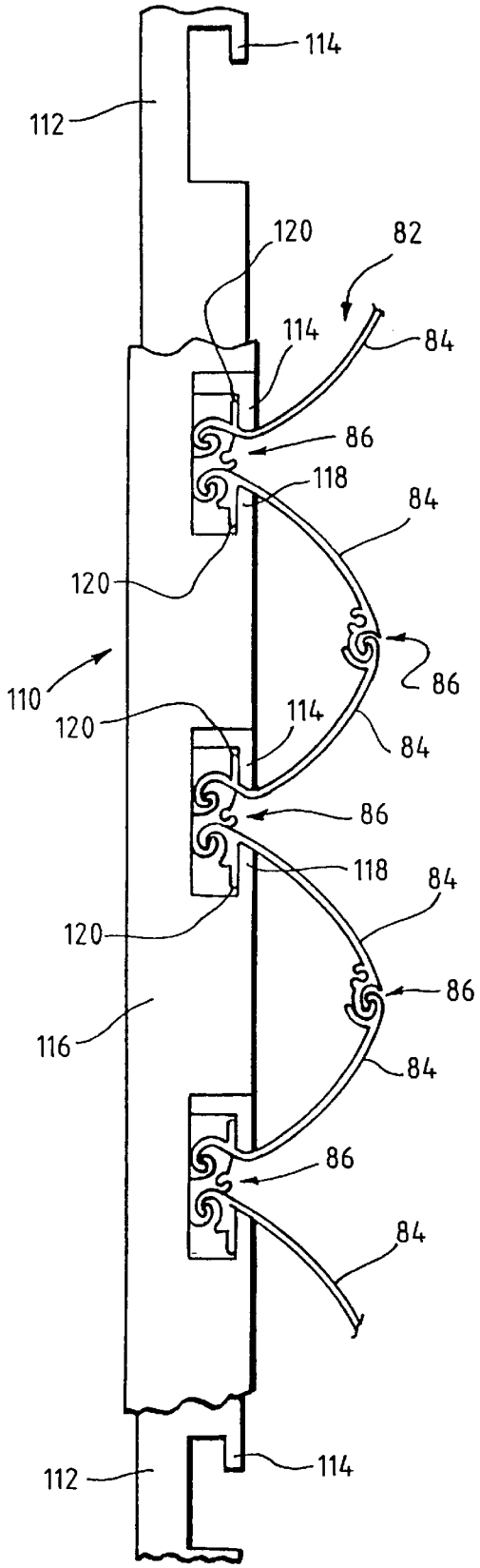
FIG. 7 is a side view of a shutter assembly engaged by a unitizing bar.

FIG. 7 illustrates the use of a rigid member, such as the unitizing bar 110, to increase the strength of shutter 82 against impact. The unitizing bar 110 is adapted to attach to the shutter 82 by engaging a plurality of hinges 86 in a manner that prevents the relative motion of an engaged hinge 86 with respect to the other engaged hinges 86, and prevents the rotation of the slats 84 about the engaged hinges 86.

One example of the unitizing bar 110, as illustrated in FIG. 7, is composed of an inner member 112 having a plurality of upper jaws 114 and an outer member 116 having a plurality of lower jaws 118 corresponding to the upper jaws 114. The outer member 116 is adapted to slide over the inner member 112 so that the jaws 114, 118 can be opened and closed. The engaged hinges 86 may be provided with extrusions 120 which are grasped by the jaws 114, 118 when the unitizing bar 110 is closed around the engaged hinges 86. The unitizing bar 110 further includes a locking mechanism (not shown) for securing the unitizing bar 110 in the closed position. Other rigid members for securing the hinges 86 and mechanisms for engaging the hinges 86 will be apparent to those skilled in the art.

Rolling shutters in general, and, in particular, rolling shutters according to the present invention, must be locked in place to prevent a burglar from lifting the shutter curtain. In vertically aligned rolling shutters, the shutter curtain is locked either by attaching the top slat directly to the drive tube or, more commonly, by utilizing a lock hanger to force the top slat towards the top or back of the housing to lock the shutter in place. The lock hangers include brackets mounted on the back wall of the shutter housing and a piece of spring steel which connects the top slat to the roller tube. When the shutter is deployed, the spring steel pushes the top shutter toward the back wall of the shutter housing underneath the brackets such that the brackets will engage the top slat to prevent the curtain from being removed. When the shutter is rolled up, the spring steel pulls the top slat away from the back wall of the shutter housing to allow the shutter curtain to be rolled up on the take-up roll. With either locking arrangement, a vertically aligned shutter is easily adjusted for side tracks of different lengths by adding slats to, or removing slats from, the shutter curtain.

In the rolling shutters according to the present invention such as shutter 80 in FIG. 4, the top slat must be locked in place not only to prevent raising of the shutter curtain, but to also prevent flattening of the shutter curtain if a force is applied to one of the hinges. Due to the alternating configuration of the slats, the upper end of one of the slats 84*a* must be forced against the back wall of the shutter housing. Due to the distance spanned by each pair of alternated slats 84*a*, 84*b* and the need to accommodate varying side track heights, a mechanism is required for adjusting the height of the shutter curtain to ensure that the upper end of a slat 84*a* can be locked against the back wall of the shutter housing.

FIGS. 21(*a*)–(*h*) illustrate schematically several alternative arrangements for adjusting the curtain height of rolling shutters according to the present invention. In the arrangement shown in FIGS. 21(*a*) and (*b*), an adjustable bottom shutter 450 is provided which has a variable width. FIG. 21(*a*) shows the shutter 80 of FIG. 4 which can be locked into place by a bracket 456 with the adjustable bottom slat 450 with a shortened width. The shutter 80 is connected to a take-up roll 458 by a slat 460. When the shutter 80 is unrolled, the slat 460 pushes the top-most slat 84*a* of the shutter 80 against the back wall of the shutter housing 462. If someone attempts to lift the shutter 80 or a force is applied to one of the hinges 86, the slat 460 is engaged by the bracket 456 to prevent lifting or flattening of the shutter 80.

In FIG. 21((*b*), the shutter 80 with the same number of slats is used with a side track 354 having a slightly longer length than the side track 452. The side track 454 is not long enough to require an additional pair of slats 84*a*, 84*b*. The adjustable bottom slat 450 is widened to raise the shutter curtain enough so that the top-most slap 84*a* is in the proper position for the bracket 456 to lock the shutter curtain in place.

FIGS. 21(*c*) and (*d*) illustrate the use of an adjustable top slat 464 to lock the top-most slat 84*a* against the back wall of the shutter housing 462. For a shorter length side track 466, the adjustable top slat 464 is fully retracted to lock the top-most slat 84*a* against the back wall of the shutter housing 462. Conversely, when the same shutter curtain is installed on a longer side track 468, the adjustable top slat 464 is extended to position the top-most slat 84*a* below the bracket 456.

FIGS. 21(*e*) and (*f*) illustrate the use of a piece of spring steel 470 to connect the top-most slat 84*a* to the take-up roll 458. For a shorter side track 472, the spring steel 470 flexes a significant amount to force the top-most slat 84*a* against the back wall of the shutter housing 462. With a longer side track 474, as shown in FIG. 21(*f*), the spring steel 470 locks the top-most slat 84*a* against the back wall with less flexure because the slat 84*a* is farther below the take-up roll 458.

Finally, FIGS. 21(*g*) and (*h*) illustrate the use of a plurality of vertically aligned slats 476 to form a variable width coupling between the shutter 80 and the take-up roll 458. When the shutter curtain is assembled with a shorter length side track 478, a single vertical slat 476 is required to couple the top-most slat 84*a* to the slat 460 of FIG. 21(*a*) and, consequently, to the take-up rolls 458. When the same shutter curtain is assembled with a longer side track 480, additional vertical slats 476 are required to couple the same top-most slat 84*a* to the slat 460 and take-up roll 458. Combinations of the adjustment mechanisms described herein that can be used with the rolling shutter assemblies according to the present invention will be obvious to those of ordinary skill in the art and are contemplated by the inventor as having use in connection with the present invention.

Figure 8:
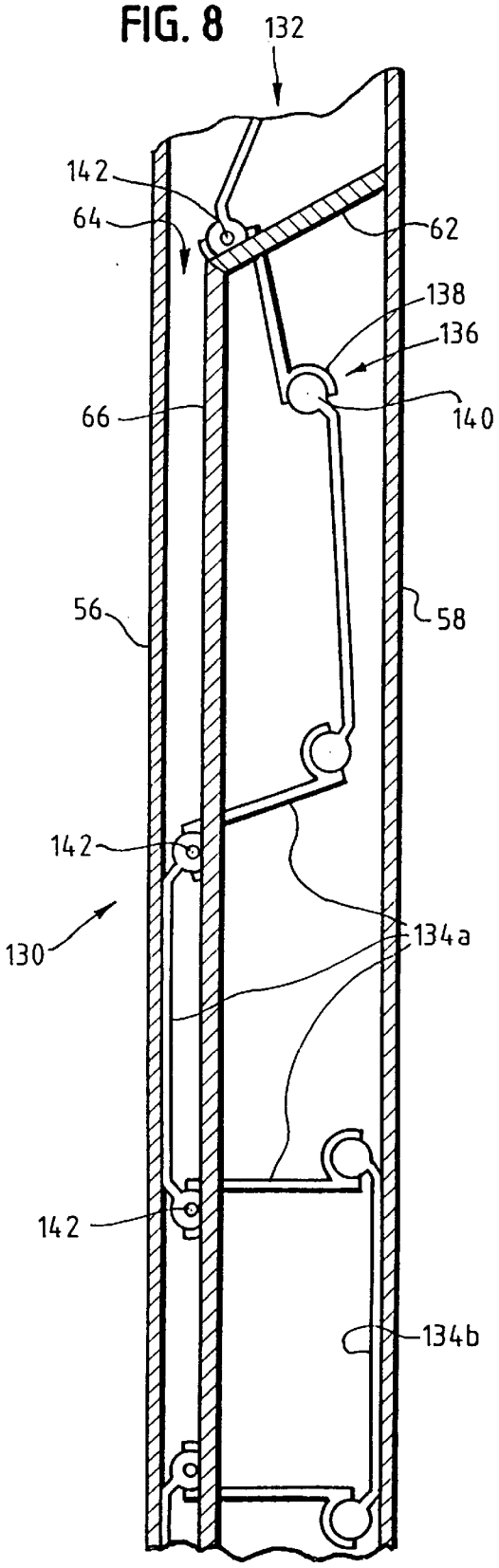
FIG. 8 is a cross-sectional side view of a portion of a third embodiment of a shutter assembly in accordance with the invention.

A portion of another embodiment of a shutter assembly 130 is shown in FIG. 8. The shutter assembly 130 has the same components of the shutter assembly 10 of FIG. 1, except that the structure of the shutter is different. The shutter assembly 130 has a shutter 132 which has a first set of slats 134*a* and a second set of slats 134*b* alternated with the first set of slats 134*a*. Each of the slats 134*a* in the first set occupies a substantially horizontal position and each of the slats 134*b* in the second set occupies a substantially vertical position.

The shutter 132 has a plurality of elongate hinges 136, each of which is composed of a semi-circular member 138 with a socket formed therein and a circular rod 140 pivotally disposed in the socket member 138, the rods 140 being integrally formed with the slats 134*a*, 134*b*. Since the socket members 138 cover slightly over half the diameter of the rods 140, the rods 140 are permanently retained within the socket members 138. When the shutter 132 is in its unrolled position, the vertically disposed slats 134*b* make contact with the sides of the shutter tracks 40.

The plate 62 and guide channel 66 act to shape the shutter 130 as it is unrolled from the shutter support member 20 to its extended position. Pins 142 extend from the rods 140 of the slats 134*b* that will contact side wall 56 when the shutter 130 is in the extended position. As the shutter 130 is unrolled, pins 142 come into contact with the plate 62 which directs the slat 134*b* toward the guide channel 64. Once in the guide channel 64, the guide wall 66 retains the pins 142 within the guide channel 64.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A rolling shutter assembly, comprising:

a shutter support member;

a shutter coupled to said shutter support member, said shutter comprising a plurality of shutter members, said shutter members each comprising a slat and a hinge connected to said slat, said shutter members being grouped in a first set and a second set, each of said shutter members in said first set having a first end portion with a first extension member which extends outwardly from said first end portion, and each of said shutter members of said second set having a second end portion with a second extension member which extends outwardly from said second end portion;

a pair of shutter tracks each having first and second side walls and an end wall;

means for rolling said shutter from an extended position in which said first end portions of said shutter members are disposed in said shutter tracks to a retracted position in which said shutter is rolled up on said shutter support member;

a pair of guide channels, each of said guide channels being associated with one of said shutter tracks; and guide means associated with each of said guide channels, said guide means causing said first extension members to be disposed within said guide channels and said second extension members to be disposed outside of said guide channels when said shutter is in said extended position.

2. A rolling shutter assembly according to claim 1, wherein each of said guide means comprises:

a rigid member adapted to engage said first extension members as said shutter is unrolled to said extended position; and a guide member adapted to engage said second extension members so that said second extension members are disposed outside of said guide channels.

3. A rolling shutter assembly according to claim 2, wherein each of said guide members comprises a deployment member pivotally connected to said shutter track proximate said rigid member and said guide channel, said deployment member having a first position wherein said deployment member is adapted to engage said first extension members to prevent said first extension members from being disposed outside of said guide channel, and a second position wherein said deployment member is adapted to engage said second extension members to prevent said second extension members from being disposed within said guide channel.

4. A rolling shutter assembly according to claim 3, wherein said deployment member is set to said first position when one of said second extension members engages said deployment member and set to said second position when one of said first extension members engages said deployment member.

5. A rolling shutter assembly according to claim 3, wherein each of said rigid members is adapted to engage said second extension members whereby said rigid members cause said second extension members to engage said deployment members.

6. A rolling shutter assembly according to claim 1, wherein each of said guide means comprises:

a rigid member adapted to engage said first extension members as said shutter is unrolled to said extended position; and a guide member adapted to engage said shutter members of the second set so that said second extension members are disposed outside of said guide channels.

7. A rolling shutter assembly according to claim 6, wherein each of said guide members comprises a resilient member connected to said shutter track, said resilient member adapted to deflect when said first extension members are guided into said guide channel by said guide members, and adapted to prevent said second extension members from being disposed within said guide channel.

8. A rolling shutter assembly according to claim 7, wherein said resilient member is fabricated from a single piece of spring steel.

* * * * *